US010655430B2

(12) United States Patent
Strohla et al.

(10) Patent No.: US 10,655,430 B2
(45) Date of Patent: May 19, 2020

(54) TOP-DOWN SQUEEZE SYSTEM AND METHOD

(71) Applicant: Halliburton Energy Services, Inc., Houston, TX (US)

(72) Inventors: Nicholas Lee Strohla, Dallas, TX (US); Matthew Ryan Gray, Dallas, TX (US); Daniel Keith Moeller, Argyle, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 193 days.

(21) Appl. No.: 15/554,635

(22) PCT Filed: Nov. 15, 2016

(86) PCT No.: PCT/US2016/061986
§ 371 (c)(1),
(2) Date: Aug. 30, 2017

(87) PCT Pub. No.: WO2018/093346
PCT Pub. Date: May 24, 2018

(65) Prior Publication Data

US 2018/0245426 A1 Aug. 30, 2018

(51) Int. Cl.
*E21B 34/14* (2006.01)
*E21B 34/10* (2006.01)
(Continued)

(52) U.S. Cl.
CPC ..... *E21B 34/10* (2013.01); *E21B 23/006* (2013.01); *E21B 33/14* (2013.01); *E21B 33/143* (2013.01);
(Continued)

(58) Field of Classification Search
CPC .. E21B 2034/007; E21B 34/14; E21B 23/006; E21B 34/10
See application file for complete search history.

(56) References Cited

U.S. PATENT DOCUMENTS 4,674,569 A 6/1987 Revils et al.
8,733,474 B2 * 5/2014 Nikiforuk ..... E21B 7/20 166/208
(Continued)

FOREIGN PATENT DOCUMENTS

CA 2928453 A1 10/2016
EP 0427422 A2 5/1991
(Continued)

OTHER PUBLICATIONS

International Search Report and Written Opinion dated Aug. 1, 2017; International PCT Application No. PCT/US2016/061986.
(Continued)

*Primary Examiner* — Catherine Loikith
(74) *Attorney, Agent, or Firm* — McGuireWoods LLP

(57) ABSTRACT

A downhole tool subassembly having an outer sleeve with a first set of apertures extending from an inner bore through an external surface of the outer sleeve. The downhole tool subassembly further includes a pin coupled to the outer sleeve and extending inward from the inner bore of the outer sleeve, and an inner sleeve slidingly engaged with the with outer sleeve. The inner sleeve has a slot and a second set of apertures extending from a sleeve bore of the inner sleeve through an external surface of the inner sleeve, and is operable to restrict flow across the first set of apertures when the inner sleeve is in a first position. The pin engages the slot, which includes a first tracking path and a second tracking path. The slot also includes a first transition path extending from the first tracking path to the second tracking path.

14 Claims, 14 Drawing Sheets

(51) Int. Cl.
*E21B 23/00* (2006.01)
*E21B 33/14* (2006.01)
*E21B 34/00* (2006.01)

(52) U.S. Cl.
CPC ..... *E21B 34/14* (2013.01); *E21B 2034/007* (2013.01)

(56) References Cited

U.S. PATENT DOCUMENTS

| | | | | |
|---|---|---|---|---|
| 8,757,273 | B2 * | 6/2014 | Themig | E21B 34/102 166/373 |
| 8,800,655 | B1 | 8/2014 | Bailey | |
| 9,010,447 | B2 | 4/2015 | Themig et al. | |
| 9,752,412 | B2 * | 9/2017 | Shkurti | E21B 34/063 |
| 2009/0314548 | A1 | 12/2009 | Fanuel et al. | |
| 2011/0203809 | A1 | 8/2011 | Knobloch, Jr. et al. | |
| 2014/0102703 | A1 | 4/2014 | Mailand et al. | |
| 2014/0158361 | A1 | 6/2014 | Cheng et al. | |
| 2014/0166912 | A1 | 6/2014 | Larisey et al. | |
| 2014/0318806 | A1 | 10/2014 | Machocki | |
| 2014/0352970 | A1 | 12/2014 | Kristoffer | |
| 2016/0115765 | A1 | 4/2016 | Kristoffer et al. | |
| 2016/0251939 | A1 | 9/2016 | Johnson et al. | |
| 2016/0273322 | A1 | 9/2016 | Russo et al. | |

FOREIGN PATENT DOCUMENTS

| | | | |
|---|---|---|---|
| WO | 2004088091 | A1 | 10/2004 |
| WO | 2009029437 | A1 | 5/2009 |
| WO | 2011008591 | A2 | 1/2011 |
| WO | 2012094749 | A1 | 7/2012 |
| WO | 2014116237 | A1 | 7/2014 |

OTHER PUBLICATIONS

International Search Report and Written Opinion dated Jul. 28, 2017; International PCT Application No. PCT/US2016/061988.
Netherlands Search Report dated Apr. 20, 2018; Netherlands Application No. 2019726.
Netherlands Search Report dated Mar. 26, 2018; Netherlands Application No. 2019727.
European Search Report dated Aug. 1, 2019, European Patent Application No. 16921531.6.

* cited by examiner

TOP-DOWN SQUEEZE SYSTEM AND METHOD

BACKGROUND

The present disclosure relates to oil and gas exploration and production, and more particularly to a completion tool used in connection with delivering cement to a wellbore.

Wells are drilled at various depths to access and produce oil, gas, minerals, and other naturally-occurring deposits from subterranean geological formations. As a part of the well completion process, hydraulic cement compositions are commonly utilized to complete oil and gas wells that are drilled to recover such deposits. For example, hydraulic cement compositions may be used to cement a casing string in a wellbore in a primary cementing operation. In such an operation, a hydraulic cement composition is pumped into the annular space between the walls of a well bore and the exterior of a casing string disposed therein. After pumping, the composition sets in the annular space to form a sheath of hardened cement about the casing. The cement sheath physically supports and positions the casing string in the well bore to prevent the undesirable migration of fluids and gasses between zones or formations penetrated by the well bore.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

Figure 1:
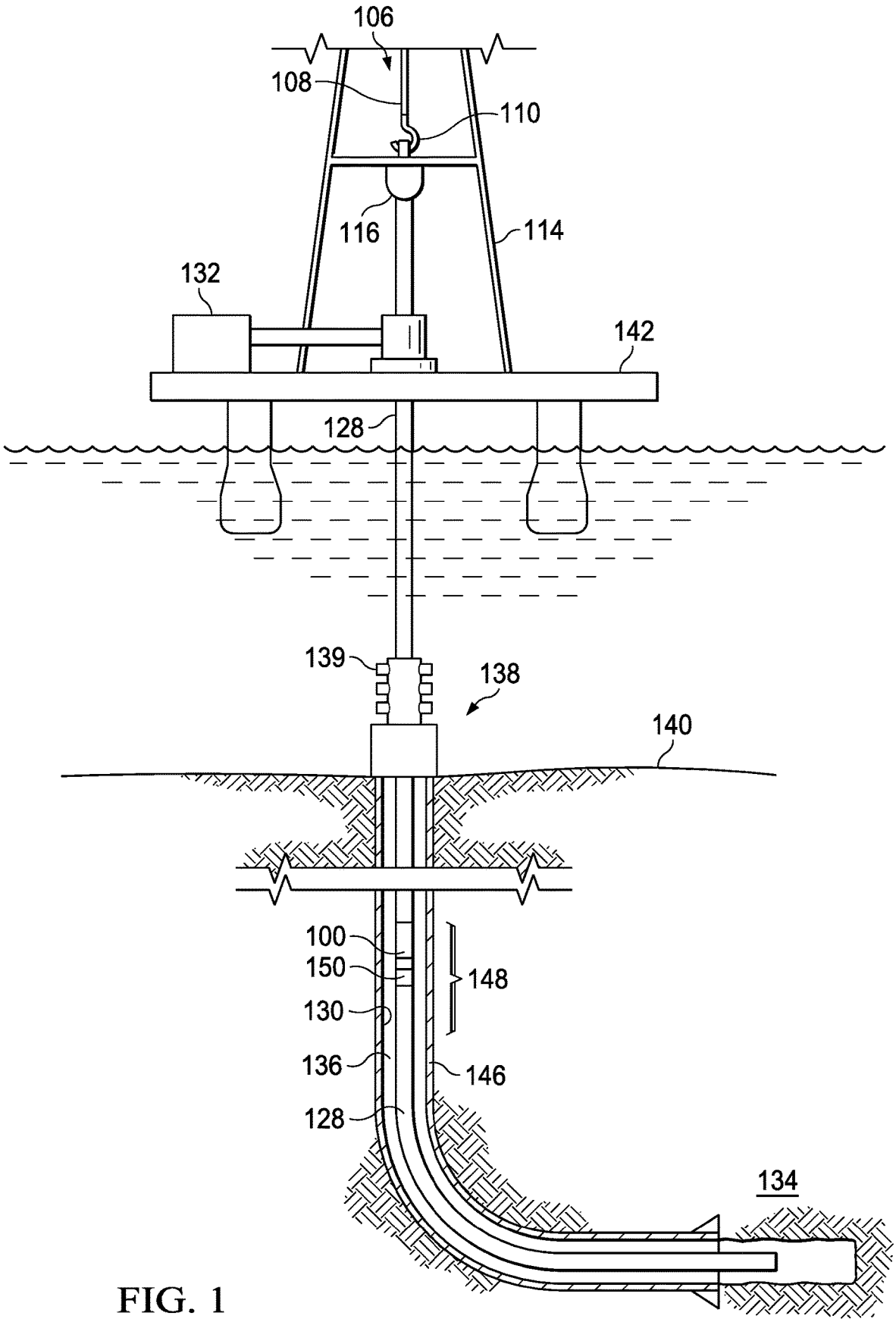
FIG. 1 illustrates a schematic view of an off-shore well in which a tool string is deployed according to an illustrative embodiment.

The illustrated figures are only exemplary and are not intended to assert or imply any limitation with regard to the environment, architecture, design, or process in which different embodiments may be implemented.

DETAILED DESCRIPTION OF ILLUSTRATIVE EMBODIMENTS

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, fluidic, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

During the completion of a well, and after primary cementing, it may be necessary in some instances to cement a portion of a wellbore that extends above a previously cemented portion of the wellbore. In such instances, a "squeeze" operation may be employed in which the cement is deployed in an interval of a wellbore from the top down (i.e., downhole). The present disclosure relates to subassemblies, systems and method for diverting fluid in a wellbore to, for example, divert a cement slurry from a work string (such as a drill string, landing string, completion string, or similar tubing string) to an annulus between the external surface of the string and a wellbore wall to form a cement boundary over the interval and isolate the wellbore from the surrounding geographic zone or other wellbore wall.

The disclosed subassemblies, systems and methods allow an operator to perform a top-down squeeze cementing operation immediately following a traditional cementing operation and then return to a standard circulation path upon completion of the squeeze job. To that end, a diverter assembly is disclosed that has the ability to allow the passage of displacement based equipment (e.g., a cement displacement wiper dart) and fluid through its center and continue downhole while retaining the ability to open ball-actuated ports or apertures that provide a pathway to the annulus outside of the subassembly. Opening of the apertures for fluid to be diverted from the tool string to flow cement slurry or a similar fluid downhole along the annulus to perform a top-down cementing or "squeeze" operation. Following circulation of the cement, the apertures may be closed so that the tool string may be pressurized to set a tool, such as a liner hanger. The closing may also be ball-actuated, in addition to the liner hanger or other tool. To that end, the second ball may be used to close the valve and may also be used to actuate and set the liner hanger or similar tool downhole from the diverter assembly.

Cementing may be done in this manner for any number of reasons. For example, regulatory requirements may necessitate cementing a zone of a wellbore that is uphole from a zone where hydrocarbons are discovered proximate and above a previously cemented zone, or a cement interval may receive cement from a bottom hole assembly and benefit from additional cement being applied from the top of the interval.

Turning now to the figures, FIG. 1 illustrates a schematic view of an offshore platform 142 operating a tool string 128 that includes a diverter assembly 100 according to an illustrative embodiment, which is a downhole tool that may be used in top-down squeeze operations or to set a liner hanger. The diverter assembly 100 in FIG. 1 may be deployed to enable the application of a top-down squeeze operation in a zone 148 downhole from the diverter assembly 100 and to set a liner hanger 150 downhole from the diverter assembly 100. The tool string 128 may be a drill string, completion string, landing string or other suitable type of work string used to complete or maintain the well. In some embodiments, the work string may be a liner running string. In the embodiment of FIG. 1, the tool string 128 is deployed through a blowout preventer 139 in a sub-sea well 138 accessed by the offshore platform 142. A fluid supply source 132, which may be a pump system coupled to a cement slurry or other fluid reservoir, is positioned on the offshore platform 142 and operable to supply pressurized fluid to the tool string 128. As referenced herein, the "offshore platform" 142 may be a floating platform, a platform anchored to a seabed 140 or a vessel.

Figure 2:
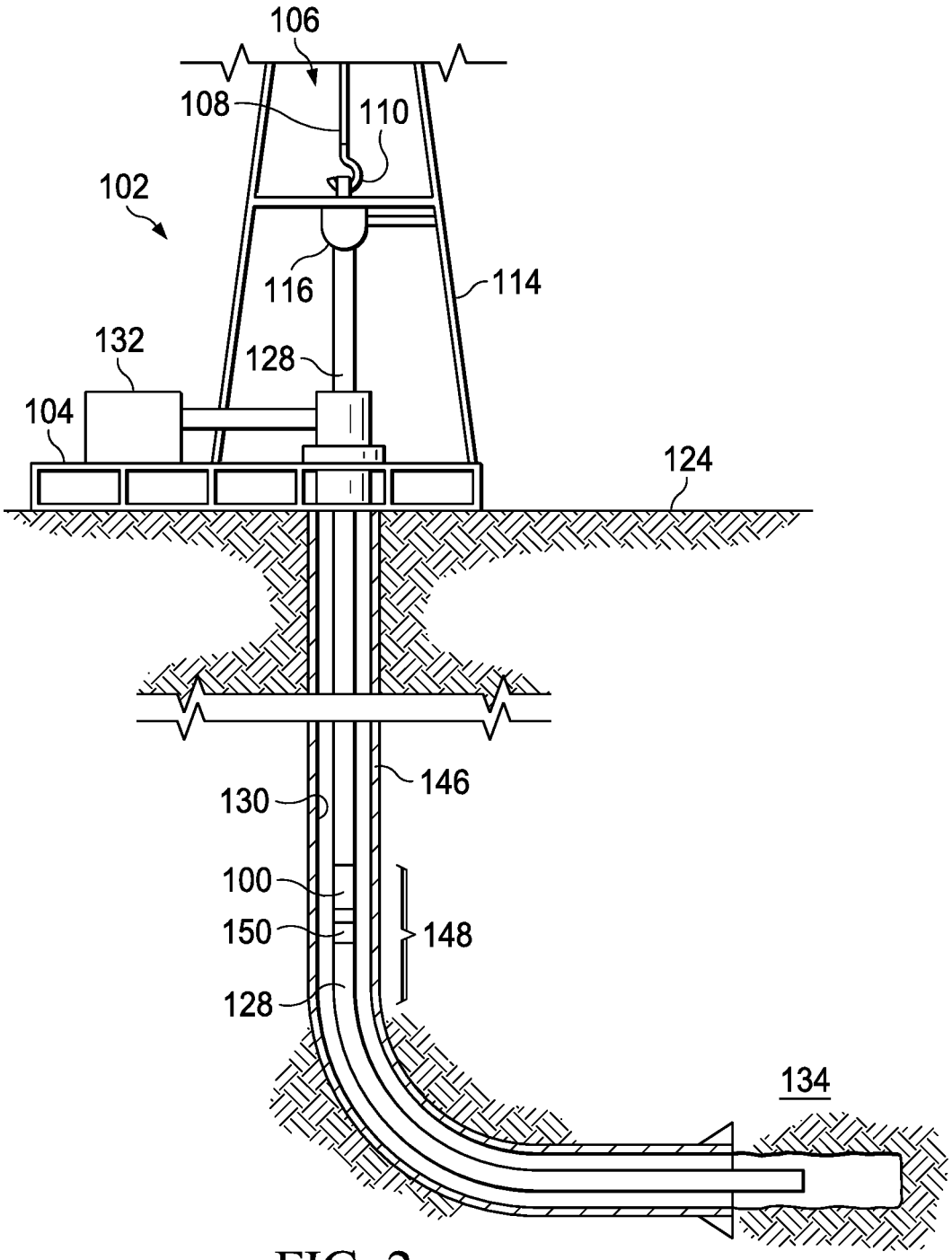
FIG. 2 illustrates a schematic view of an on-shore well in which a tool string is deployed according to an illustrative embodiment.

Alternatively, FIG. 2 illustrates a schematic view of a rig 104 in which a tool string 128 is deployed to a land-based well 102. The tool string 128 includes a diverter assembly 100 in accordance with an illustrative embodiment. The rig 104 is positioned at a surface 124 of a well 102. The well 102 includes a wellbore 130 that extends from the surface 124 of the well 102 to a subterranean substrate or formation. The well 102 and the rig 104 are illustrated onshore in FIG. 2.

FIGS. 1 and 2 each illustrate possible uses or deployments of the diverter assembly 100, which in either instance may be used in tool string 128 to apply a top-down squeeze operation and subsequently aid in the setting of a liner hanger or the utilization of another down hole device. In the embodiments illustrated in FIGS. 1 and 2, the wellbore 130 has been formed by a drilling process in which dirt, rock and other subterranean material has been cut from the formation by a drill bit operated via a drill string to create the wellbore 130. During or after the drilling process, a portion of the wellbore may be cased with a casing 146. From time to time, it may be necessary to deploy cement via the work string to form a casing in uncased zones 148 of the well above the casing 146. In some embodiments, the work string may be a liner running string. This is typically done in a top down squeeze operation in which cement is delivered to the wellbore through the work string and squeezed into the formation by diverting the cement to the annulus 136 between the wall of the wellbore 130 and tool and liner/casing string 128 and applying pressure via the fluid supply source 132.

The tool string 128 may refer to the collection of pipes, mandrels or tubes as a single component, or alternatively to the individual pipes, mandrels, or tubes that comprise the string. The diverter assembly 100 may be used in other types of tool strings, or components thereof, where it is desirable to divert fluid flow from an interior of the tool string to the exterior of the tool string. As referenced herein, the term tool string is not meant to be limiting in nature and may include a running tool or any other type of tool string used in well completion and maintenance operations. In some embodiments, the tool string 128 may include a passage disposed longitudinally in the tool string 128 that is capable of allowing fluid communication between the surface 124 of the well 102 and a downhole location 134.

The lowering of the tool string 128 may be accomplished by a lift assembly 106 associated with a derrick 114 positioned on or adjacent to the rig 104 or offshore platform 142. The lift assembly 106 may include a hook 110, a cable 108, a traveling block (not shown), and a hoist (not shown) that cooperatively work together to lift or lower a swivel 116 that is coupled an upper end of the tool string 128. The tool string 128 may be raised or lowered as needed to add additional sections of tubing to the tool string 128 to position the distal end of the tool string 128 at the downhole location 134 in the wellbore 130. The fluid supply source 132 may be used to deliver a fluid (e.g., a cement slurry) to the tool string 128. The fluid supply source 132 may include a pressurization device, such as a pump, to deliver positively pressurized fluid to the tool string 128.

Figure 3:
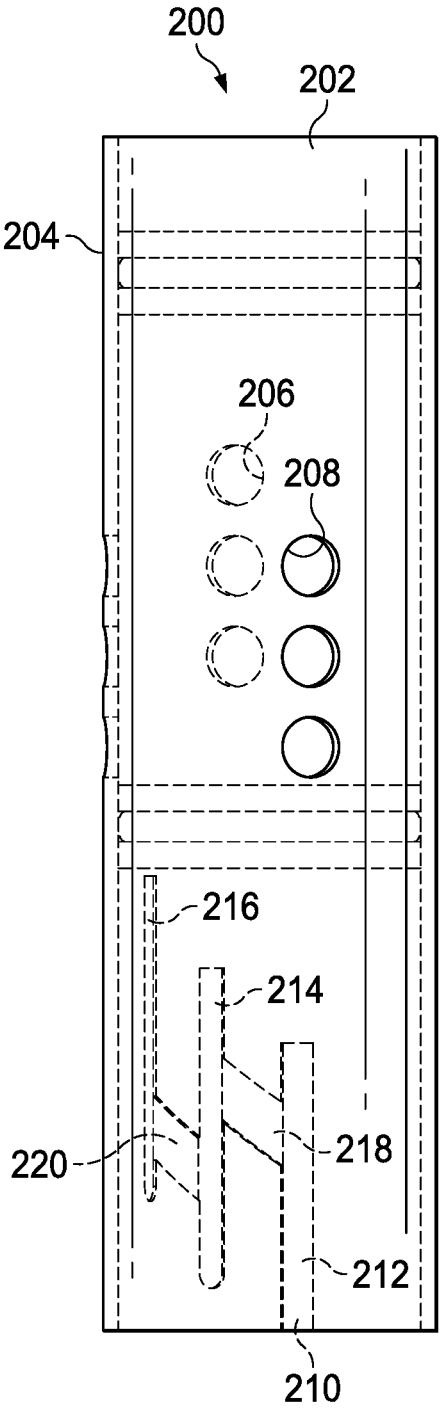
FIG. 3 illustrates a schematic, side view an illustrative embodiment of a diverter assembly.
Figure 4:
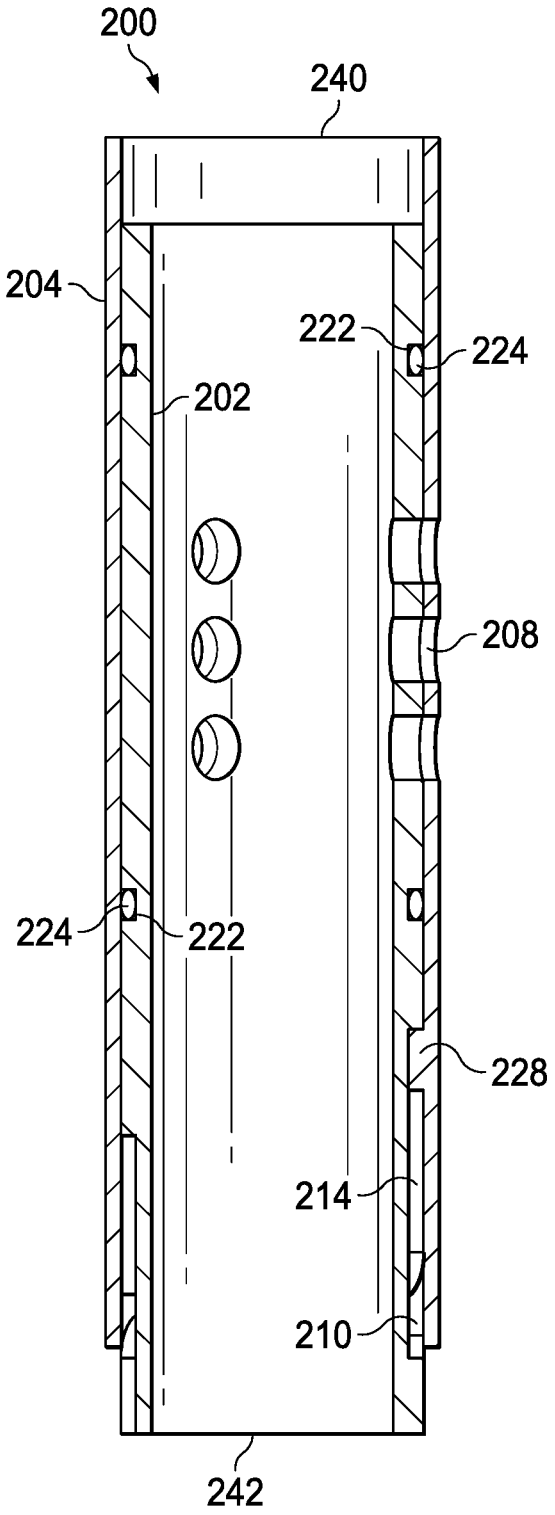
FIG. 4 is a schematic, cross-section view of the diverter assembly of FIG. 3 in which the diverter assembly is in a second configuration.
Figure 5:
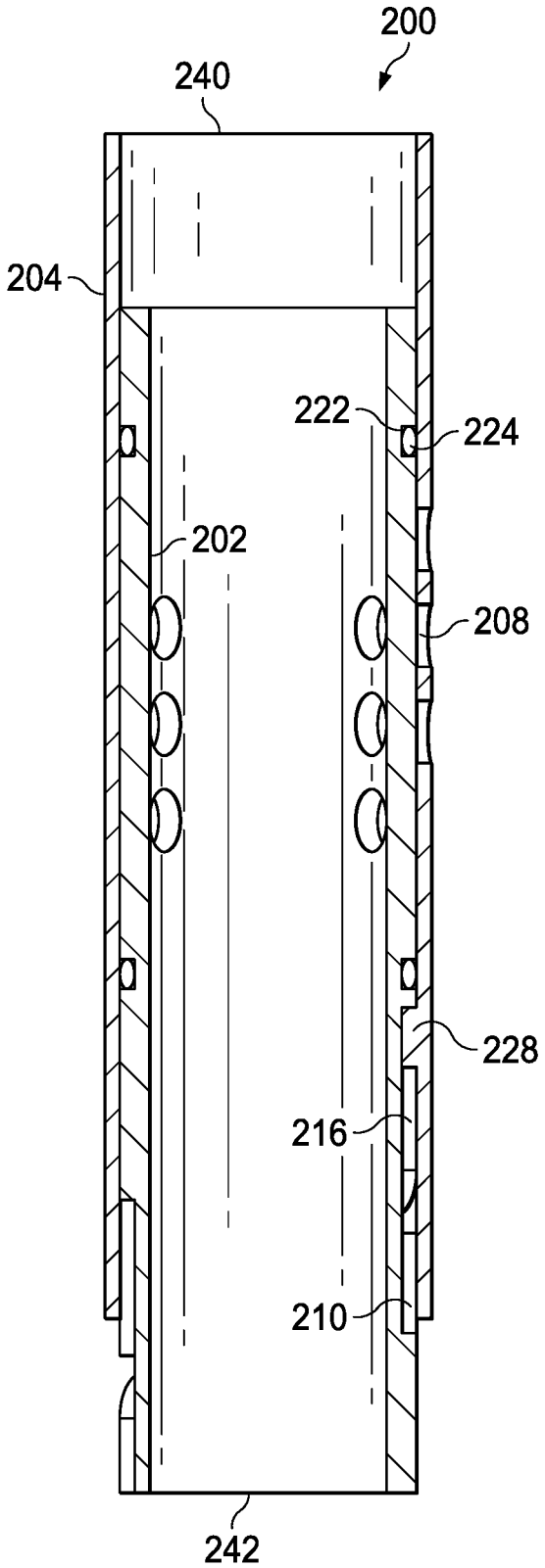
FIG. 5 is a schematic, cross-section view of the diverter assembly of FIG. 3 in which the diverter assembly is in a third configuration.

An illustrative embodiment of a downhole tool, diverter assembly 200, is shown in FIGS. 3-5. The diverter assembly 200 includes a tubing segment, which may be an outer sleeve 204, that may be inserted between upper and lower sections of a tool string or piping disposed therein. To facilitate coupling to a tool string, the ends of the outer sleeve 204 may be fabricated with standard API threads and attached in line with other elements of the tool string as a component immediately downhole from a tool joint adapter. Alternatively, tool joint adapter features may be incorporated into the diverter assembly itself. The outer sleeve 204 has an inlet 240 at an uphole end and an outlet 242 at a downhole end. A guide feature, such as a pin 228 extends into the inner bore of the outer sleeve 204, and may be assembled to the outer sleeve 204 or formed integrally with the outer sleeve 204.

An inner sleeve 202 is positioned within outer sleeve 204 and has an outer diameter that allows the inner sleeve 202 to snugly fit within the inner bore of the outer sleeve 204. The inner sleeve 202 has a circuitous slot 210 that is configured to receive the pin 228 to guide the movement of the inner sleeve 202 within the outer sleeve 204. The circuitous slot 210 includes three longitudinal tracks that are parallel to a longitudinal axis 201 of the inner sleeve 202. In the illustrative embodiment of FIG. 3, the circuitous slot 210 includes a first longitudinal track 212, a second longitudinal track 214, and a third longitudinal track 216. The second longitudinal track 214 may be offset from the first longitudinal track 212 by a degree of rotation and/or an axial distance such that an uphole portion of the second longitudinal track 214 is uphole from an uphole portion of the first longitudinal track 212. Similarly, the third longitudinal track 216 may be offset from the second longitudinal track 214 by a degree of rotation and/or an axial distance such that an uphole portion of the third longitudinal track 216 is uphole from the uphole portion of the second longitudinal track 214. The first longitudinal track 212 may be connected to the second longitudinal track 214 by a first transition track 218 that forms a diagonal, uphole path from the first longitudinal track 212 to the second longitudinal track 214. Correspondingly, the second longitudinal track 214 may be connected to the third longitudinal track 216 by a second transition track 220 that forms a diagonal, uphole path from the second longitudinal track 214 to the third longitudinal track 216. In some embodiments, the intersection between the first transition track 218 and second longitudinal track 214 is uphole from the intersection between the second longitudinal track 214 and second transition track 220.

It is noted that while the longitudinal tracks are shown as being substantially vertical, or parallel to the longitudinal axis 201 of the inner sleeve 202, the longitudinal tracks may vary from being parallel without departing from the scope of the invention (e.g., a curved or slanted shape may be used instead). Further, while the illustrative embodiment shows three longitudinal tracks and two transition tracks, any number of additional longitudinal tracks and corresponding transition tracks may be used to provide additional indexing positions of the inner sleeve 202 relative to the outer sleeve 204, as described in more detail below.

The inner sleeve 202 includes first apertures 206 that may align with second apertures 208 formed in the outer sleeve 204 in some configurations. In the embodiment of FIGS. 3-5, the first apertures 206 and second apertures 208 are (a) misaligned when the inner sleeve 202 is in a first position relative to the outer sleeve 204 corresponding to the pin 228 being positioned in an uphole portion of the first longitudinal track 212; (b) aligned when the inner sleeve 202 is in a second position relative to the outer sleeve 204 corresponding to the pin 228 being positioned in an uphole portion of the second longitudinal track 214; and (c) misaligned when the inner sleeve 202 is in a third position relative to the outer sleeve 204 corresponding to the pin 228 being positioned in an uphole portion of the third longitudinal track 216. As such, the first apertures 206 may be positioned on the inner sleeve 202 relative to the uphole portion of the second longitudinal track 214 at a distance that corresponds to the position of the second apertures 208 of the outer sleeve 204 relative to the pin 228. To facilitate a sealing engagement between the inner sleeve 202 and outer sleeve 204, the inner sleeve 202 and/or outer sleeve 204 may be formed with grooves 222 for receiving a seal or sealing element 224, such as an o-ring or similar seal.

In the embodiment of FIGS. 3-5, the first apertures 206 and second apertures 208 are shown as being arranged longitudinally in a single column along the inner sleeve 202 and outer sleeve 204, respectively. In some embodiments, each of the first apertures 206 and second apertures 208 may include multiple columns of apertures, or an array of apertures. In such an embodiment, alignment of the first apertures 206 relative to the second apertures 208 may be achieved primarily by effecting rotational displacement of the inner sleeve 202 relative to the outer sleeve 204.

Figure 3A:
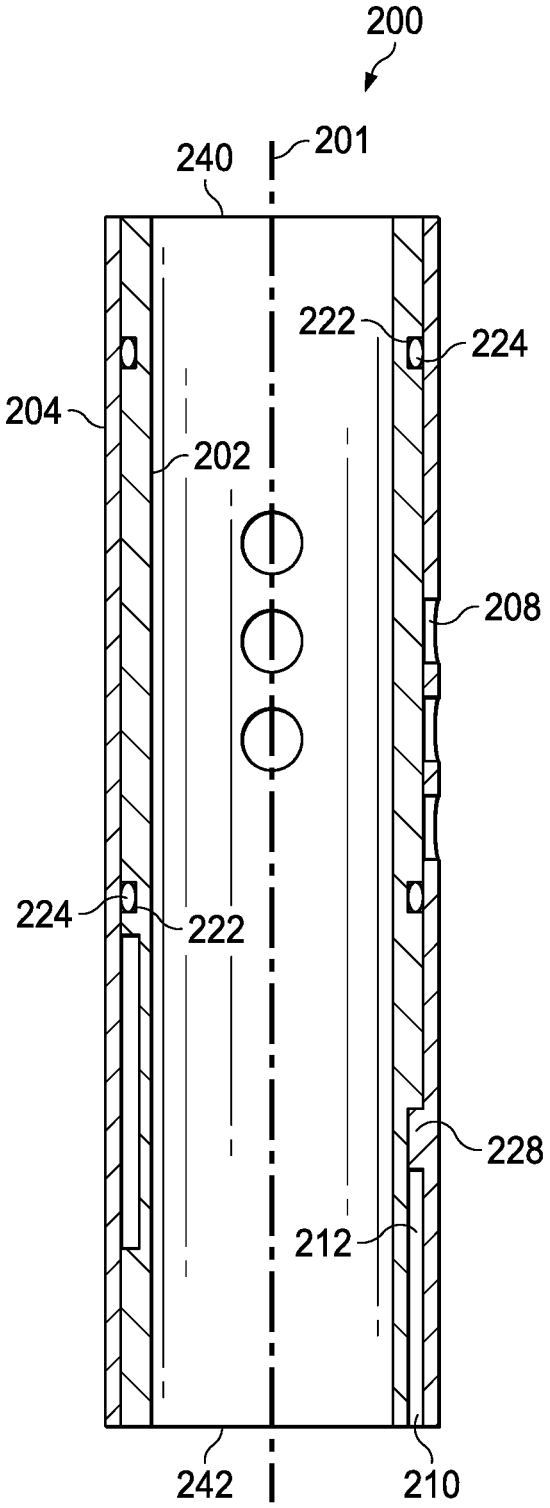
FIG. 3A is a schematic, cross-section view of the diverter assembly of FIG. 3 in which the diverter assembly is in a first configuration.

In FIG. 3A, the diverter assembly is shown in the first configuration, in which the first apertures 206 are misaligned with the second apertures 208. In FIG. 4, the work string including the diverter assembly 200 may have been transitioned from tension to compression and back, while simultaneously being rotated to cause the inner sleeve 202 to be displaced relative to the outer sleeve 204 by the pin 228 travelling along the first transition track 218 and to the uphole portion of the second longitudinal track 214. The pin 228 being positioned in the uphole portion of the second longitudinal track 214 corresponds to the diverter assembly 200 being in the second configuration in which the first apertures 206 are aligned with the second apertures 208 such that fluid within the diverter assembly 200 is permitted to flow through the first apertures 206 and second apertures 208 to an annulus surrounding the outer sleeve 204.

Similarly, in FIG. 5, the work string including the diverter assembly 200 may have again been transitioned from tension to compression and back, while simultaneously being rotated to cause the inner sleeve 202 to be displaced relative to the outer sleeve 204 by the pin 228 travelling along the second transition track 220 and to the uphole portion of the third longitudinal track 216. The pin 228 being positioned in the uphole portion of the third longitudinal track 216 corresponds to the diverter assembly 200 being in the third configuration in which the first apertures 206 are again misaligned with the second apertures 208 such that fluid within the diverter assembly 200 is not permitted to flow through the first apertures 206 and second apertures 208.

Figure 6:
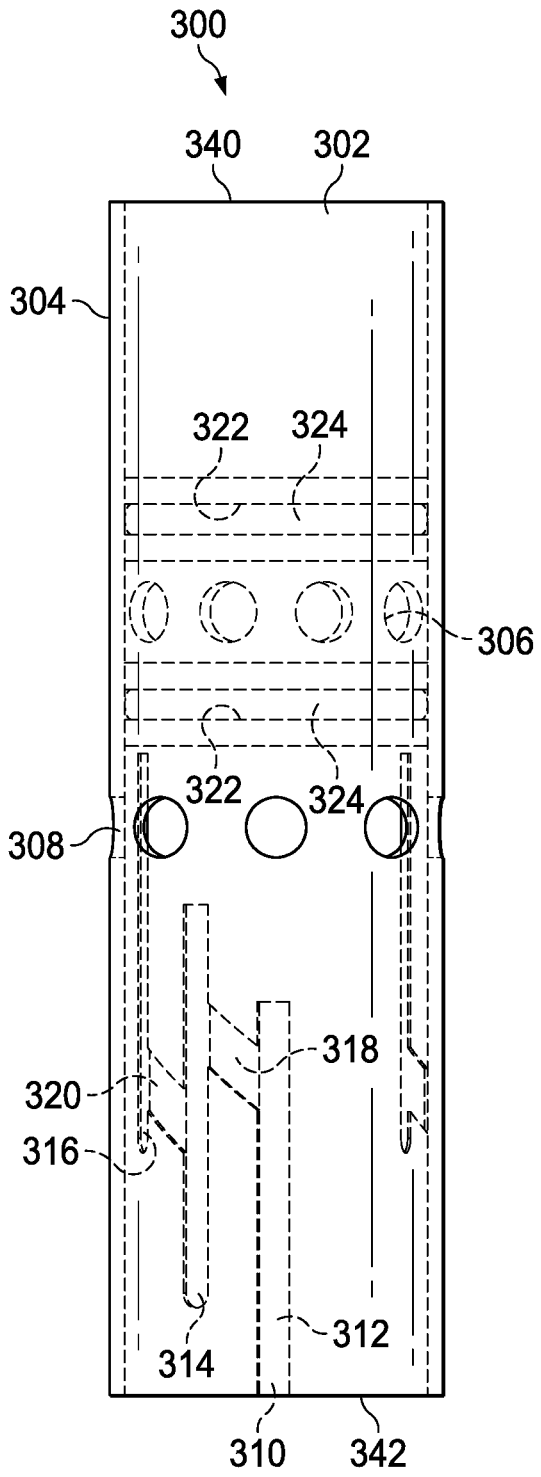
FIG. 6 illustrates a schematic, side view of an alternative embodiment of a diverter assembly.
Figure 7:
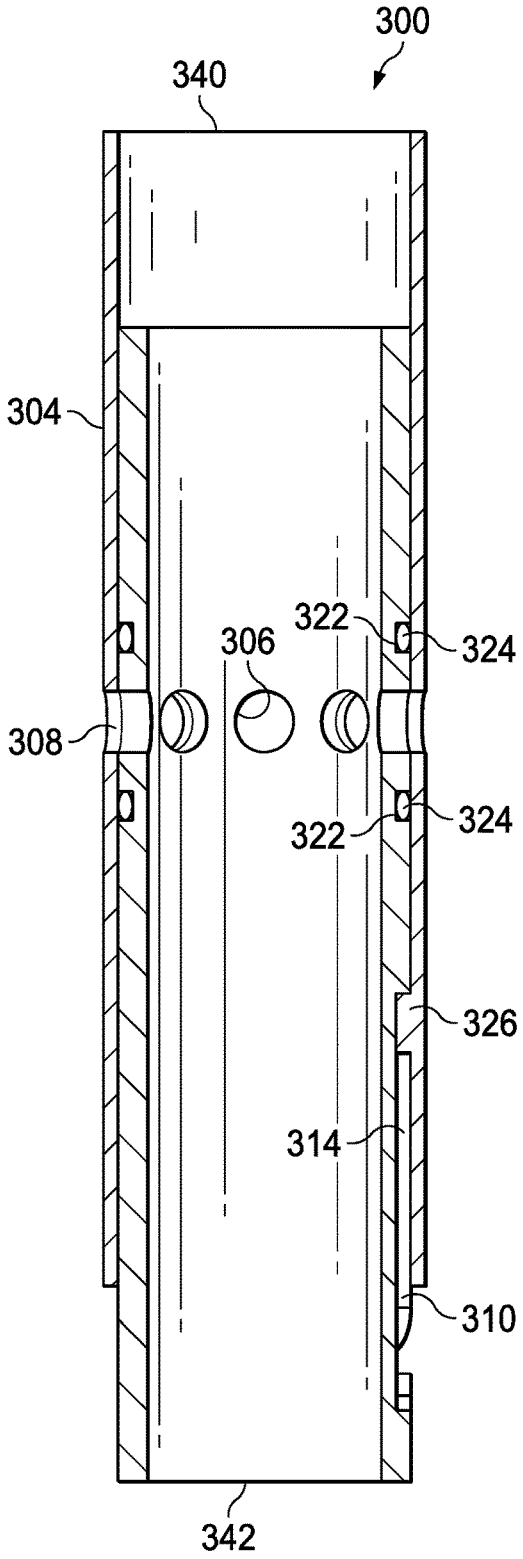
FIG. 7 is a schematic, cross-section view of the diverter assembly of FIG. 6 in which the diverter assembly is in a second configuration.
Figure 8:
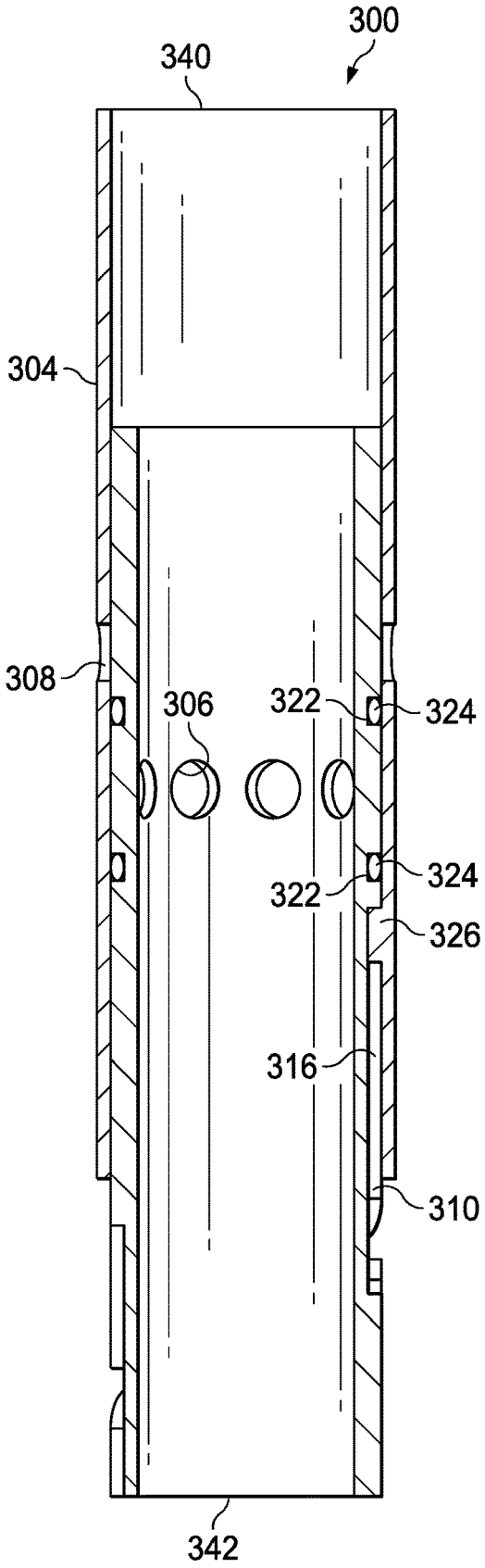
FIG. 8 is a schematic, cross-section view of the diverter assembly of FIG. 6 in which the diverter assembly is in a third configuration.

An alternative embodiment of a diverter assembly 300 is described with regard to FIGS. 6-8. Like the diverter assembly 200 of FIGS. 3-5, the diverter assembly 300 includes an outer sleeve 304 that may be inserted between upper and lower sections of a tool string or piping disposed therein. The outer sleeve 304 has an inlet 340 at an uphole end and an outlet 342 at a downhole end. A guide feature, such as a pin 326 extends into the inner bore of the outer sleeve 304, and may be assembled to the outer sleeve 304 or formed integrally with the outer sleeve 304.

An inner sleeve 302 is positioned within outer sleeve 304 and has an outer diameter that allows the inner sleeve to slidingly engage the inner bore of the outer sleeve 304. The inner sleeve 302 has a circuitous slot 310 that is configured to receive the pin 326 to guide the movement of the inner sleeve 302 within the outer sleeve 304. The circuitous slot 310 includes three longitudinal tracks that are parallel to a longitudinal axis 301 of the inner sleeve 302. In the illustrative embodiment of FIG. 6, the circuitous slot 310 includes a first longitudinal track 312, a second longitudinal track 314, and a third longitudinal track 316. The second longitudinal track 314 may be offset from the first longitudinal track 312 by a degree of rotation and/or an axial distance such that an uphole portion of the second longitudinal track 314 is uphole or downhole from an uphole portion of the first longitudinal track 312. Similarly, the third longitudinal track 316 may be offset from the second longitudinal track 314 by a degree of rotation and/or an axial distance such that an uphole portion of the third longitudinal track 316 is uphole or downhole from the uphole portion of the second longitudinal track 314. The first longitudinal track 312 may be connected to the second longitudinal track 314 by a first transition track 318 that forms a diagonal, uphole path from the first longitudinal track 312 to the second longitudinal track 314. Correspondingly, the second longitudinal track 314 may be connected to the third longitudinal track 316 by a second transition track 320 that forms a diagonal, uphole path from the second longitudinal track 314 to the third longitudinal track 316.

The inner sleeve 302 includes first apertures 306 that may align with second apertures 308 formed in the outer sleeve 304 in some configurations. In the embodiment of FIGS. 6-8, the first apertures 306 and second apertures 308 are (a) misaligned when the inner sleeve 302 is in a first position relative to the outer sleeve 304 corresponding to the pin 326 being positioned in an uphole portion of the first longitudinal track 312; (b) aligned when the inner sleeve 302 is in a second position relative to the outer sleeve 304 corresponding to the pin 326 being positioned in an uphole portion of the second longitudinal track 314; and (c) misaligned when the inner sleeve 302 is in a third position relative to the outer sleeve 304 corresponding to the pin 326 being positioned in an uphole portion of the third longitudinal track 316. As such, the first apertures 306 may be positioned on the inner sleeve 302 relative to the uphole portion of the second longitudinal track 314 at a distance that corresponds to the position of the second apertures 308 of the outer sleeve 304 relative to the pin 326. To facilitate a sealing engagement between the inner sleeve 302 and outer sleeve 304, the inner sleeve 302 and/or outer sleeve 304 may be formed with grooves 322 for receiving a seal or sealing element 324, such as an o-ring or similar seal.

In the embodiment of FIGS. 6-8, the first apertures 306 and second apertures 308 are shown as being spaced by an angular distance in a single row along the inner sleeve 302 and outer sleeve 304, respectively. In some embodiments, each of the first apertures 306 and second apertures 308 may include multiple rows of apertures, or an array of apertures. Thus, the embodiment of FIGS. 6-8 may be understood to disclose an arrangement in which the first apertures 306 are aligned with the second apertures 308 by primarily axial displacement of the inner sleeve 302 relative to the outer sleeve 304.

In some embodiments, an inner sleeve may include an array of first apertures and an outer sleeve may include an array of second apertures, and the first apertures may be aligned with the second apertures by displacement of the inner sleeve relative to the outer sleeve that is primarily axial, primarily rotational, or a combination thereof.

Figure 6A:
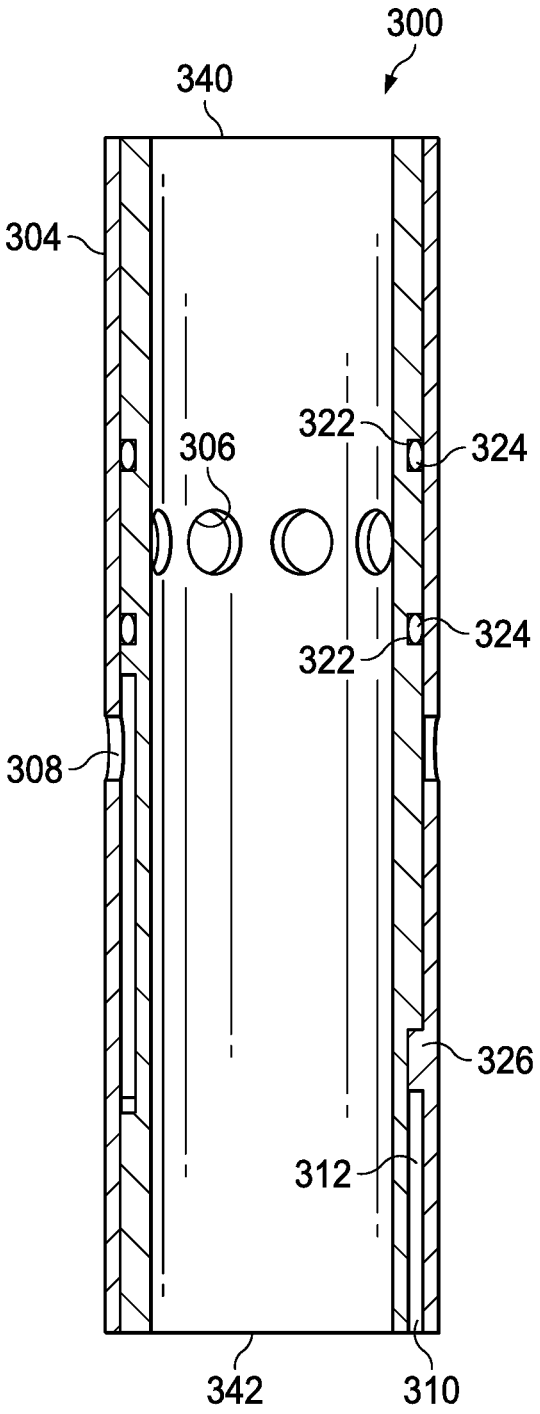
FIG. 6A is a schematic, cross-section view of the diverter assembly of FIG. 6 in which the diverter assembly is in a first configuration.

In FIG. 6A, the diverter assembly 300 is shown in the first configuration, in which the first apertures 306 are misaligned with the second apertures 308. In FIG. 7, the work string including the diverter assembly 300 may have been transitioned from tension to compression and back, while simultaneously being rotated to cause the inner sleeve 302 to be displaced relative to the outer sleeve 304 by the pin 326 travelling along the first transition track 318 and to the uphole portion of the second longitudinal track 314. The pin 326 being positioned in the uphole portion of the second longitudinal track 314 corresponds to the diverter assembly 300 being in the second configuration in which the first apertures 306 are aligned with the second apertures 308 such that fluid within the diverter assembly 300 is permitted to flow through the first apertures 306 and second apertures 308.

Similarly, in FIG. 8, the work string including the diverter assembly 300 may have again been transitioned from tension to compression and back, while simultaneously being rotated to cause the inner sleeve 302 to be displaced relative to the outer sleeve 304 by the pin 326 travelling along the second transition track 320 and to the uphole portion of the third longitudinal track 316. The pin 326 being positioned in the uphole portion of the third longitudinal track 316 corresponds to the diverter assembly 300 being in the third configuration in which the first apertures 306 are again misaligned with the second apertures 308 such that fluid within the diverter assembly 300 is not permitted to flow through the first apertures 306 and second apertures 308 to an annulus surrounding the outer sleeve 304.

Another alternative embodiment of a diverter assembly 400 is described with regard to FIGS. 9-14. The illustrative embodiment is analogous, in many respects, to the embodiments of FIGS. 3-8. Like the diverter assembly 200 of FIGS. 3-5, the diverter assembly 400 includes an outer sleeve 404 that may be inserted between upper and lower sections of a tool string or piping disposed therein. The outer sleeve 404 has an inlet 440 at an uphole end and an outlet 442 at a downhole end. A guide feature, such as a pin 426 extends into the inner bore of the outer sleeve 404, and may be assembled to the outer sleeve 404 or formed integrally with the outer sleeve 404.

Figure 9:
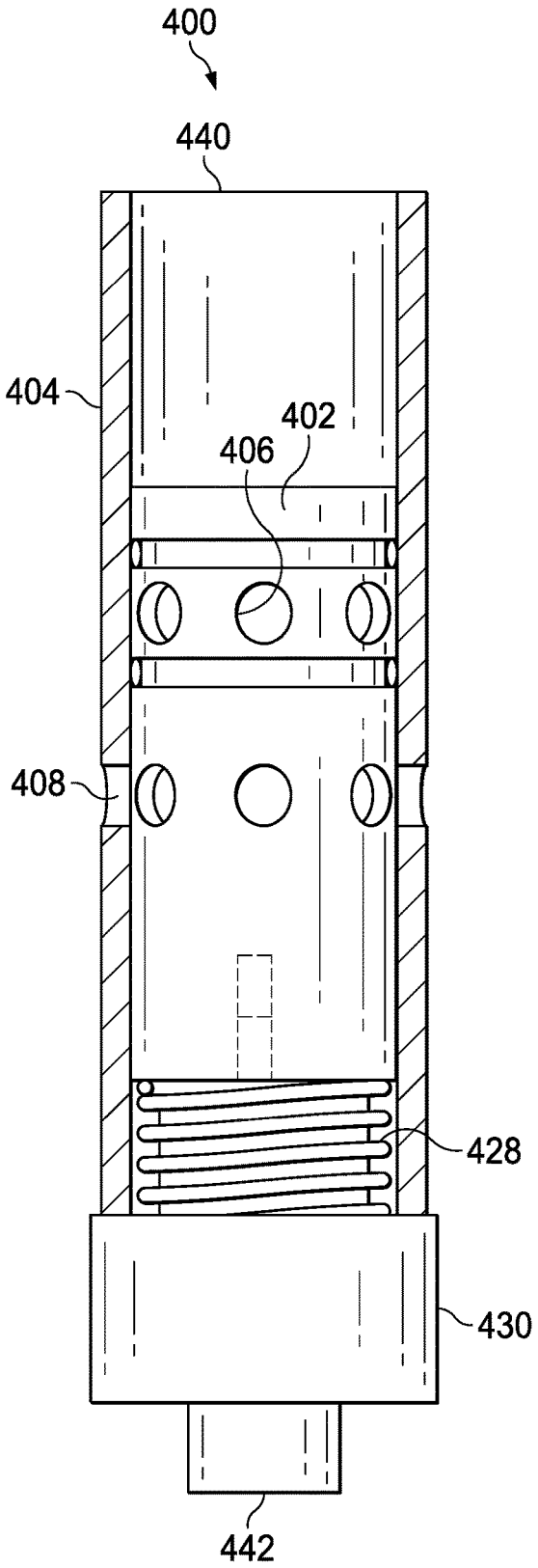
FIG. 9 illustrates a schematic, side view of an alternative embodiment of a diverter assembly.

An inner sleeve 402 is positioned within outer sleeve 404 and has an outer diameter that allows the inner sleeve 402 to slidingly engage the inner bore of the outer sleeve 404. The inner sleeve 402 has a circuitous slot 410 that is configured to receive the pin 426 to guide the movement of the inner sleeve 402 within the outer sleeve 404. The circuitous slot 410 includes two longitudinal tracks that are parallel to a longitudinal axis 401 of the inner sleeve 402, as shown in FIG. 9B. In the illustrative embodiment of FIG. 9, the circuitous slot 410 includes a first longitudinal track 412 and a second longitudinal track 414. The second longitudinal track 414 may be offset from the first longitudinal track 412 by a degree of rotation and/or an axial distance such that an uphole portion of the second longitudinal track 414 is uphole or downhole from an uphole portion of the first longitudinal track 412. The first longitudinal track 412 may be connected to the second longitudinal track 414 by a first transition track 418 that forms a diagonal, uphole path from the first longitudinal track 412 to the second longitudinal track 414.

The inner sleeve 402 includes first apertures 406 that may align with second apertures 408 formed in the outer sleeve 404 in some configurations. In the embodiment of FIGS. 9-14, the first apertures 406 and second apertures 408 are (a) misaligned when the inner sleeve 402 is in a first position relative to the outer sleeve 404 corresponding to the pin 426 being positioned in an uphole portion of the first longitudinal track 412; (b) aligned when the inner sleeve 402 is in a second position relative to the outer sleeve 404 corresponding to the pin 426 being positioned in a downhole portion of the first longitudinal track 412; and (c) misaligned when the inner sleeve 402 is in a third position relative to the outer sleeve 404 corresponding to the pin 426 being positioned in an uphole portion of the second longitudinal track 414. As such, the first apertures 406 may be positioned on the inner sleeve 402 relative to the downhole portion of the first longitudinal track 412 at a distance that corresponds to the position of the second apertures 408 of the outer sleeve 404 relative to the pin 426. To facilitate a sealing engagement between the inner sleeve 402 and outer sleeve 404, the inner sleeve 402 and/or outer sleeve 404 may be formed with grooves 422 for receiving a seal or sealing element 424, such as an o-ring or similar seal.

The diverter assembly 400 differs in several respects from the embodiments described previously. A downhole portion of the inner sleeve 402, for example, may include a smaller diameter section to provide clearance between the outer diameter of the downhole portion of the inner sleeve and the inner diameter of the outer sleeve 404 for a spring 428, which may be a coil spring or similar compressive spring. The spring 428 may be compressed against a shoulder 425 of the inner sleeve 402 by a cap 430 that is coupled to a downhole portion of the outer sleeve 404. The inner sleeve 402 may also include a sealing seat 432 for receiving a sealing member. The downhole portion of the inner sleeve 402 may have a reduced material section at and below the sealing seat 432 such that, upon the application of a preselected force, a sealing member may be extruded through the sealing seat 432.

In the embodiment of FIGS. 9-14, the first apertures 406 and second apertures 408 are shown as being spaced by an angular distance in a single row along the inner sleeve 402 and outer sleeve 404, respectively. In some embodiments, each of the first apertures 406 and second apertures 408 may include multiple rows of apertures, or an array of apertures. Thus, the embodiment of FIGS. 9-14 may be understood to disclose an arrangement in which the first apertures 406 are aligned with the second apertures 408 by primarily axial displacement of the inner sleeve 402 relative to the outer sleeve 404.

Figure 9A:
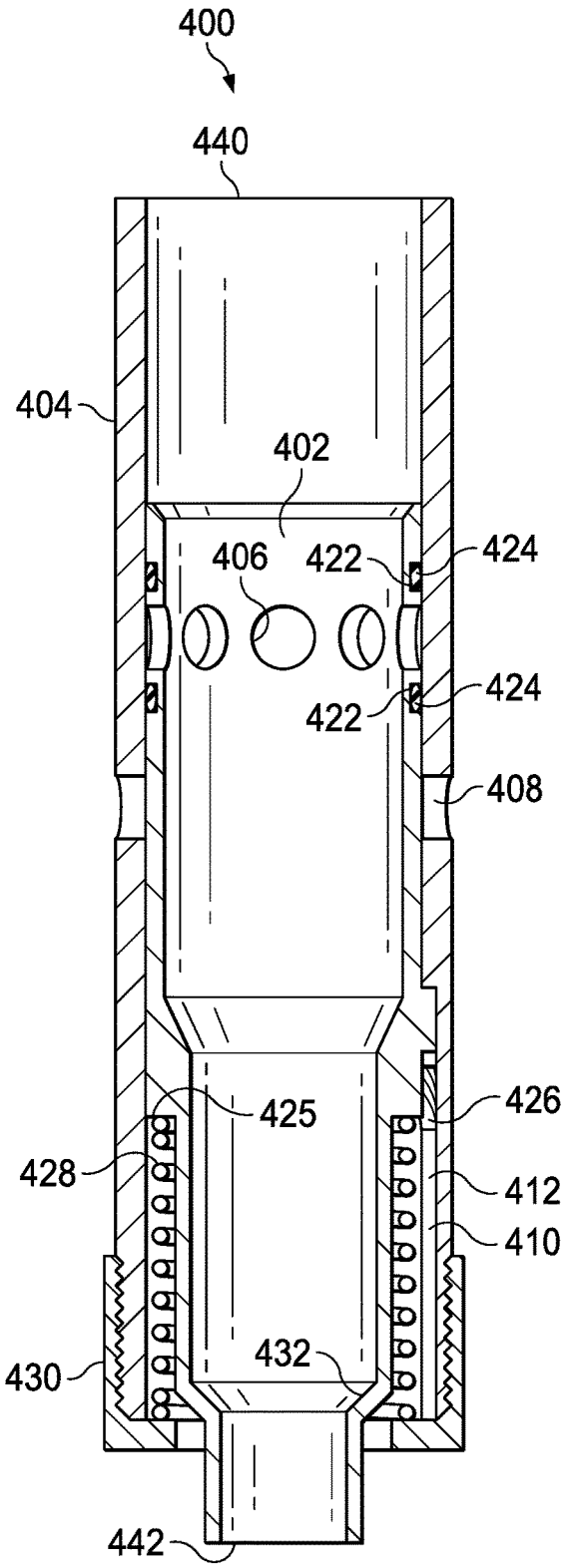
FIG. 9A is a schematic, cross-section view of the diverter assembly of FIG. 9 in which the diverter assembly is in a first configuration.
Figure 9B:
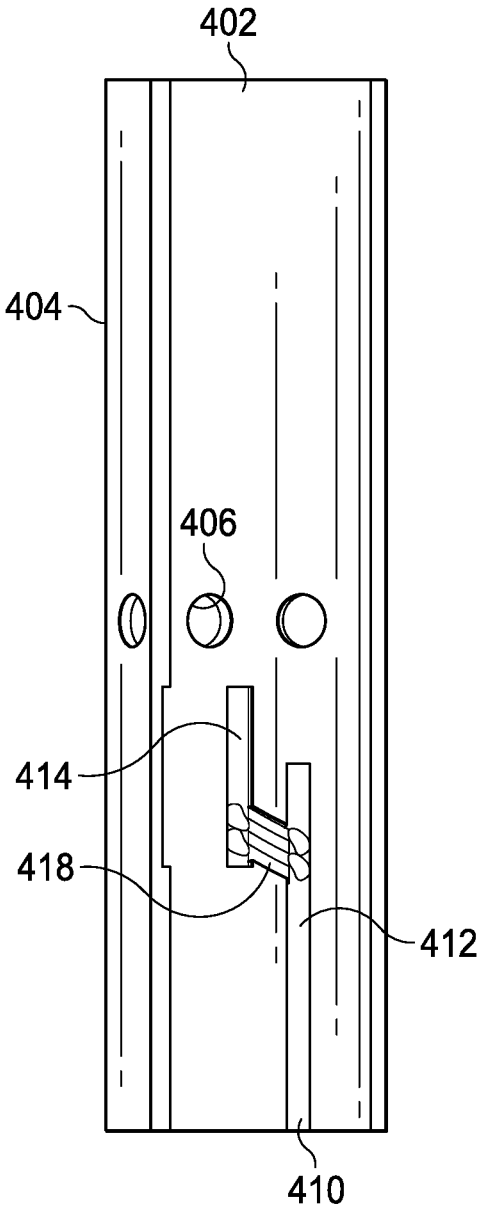
FIG. 9B is a schematic, side view of the diverter assembly of FIG. 9 in which a tubing segment of the diverter assembly is hidden.
Figure 10:
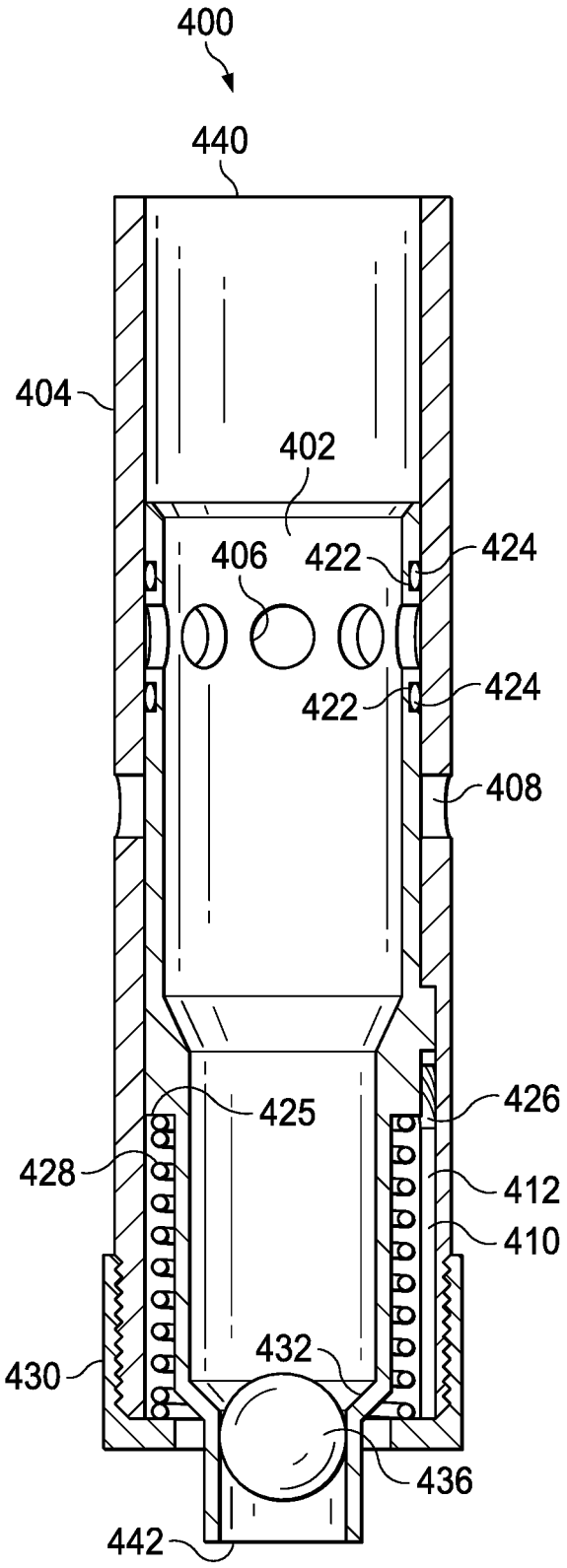
FIG. 10 is a schematic, cross-section view of the diverter assembly of FIG. 9 in which a ball has been deployed to a sealing seat of the diverter assembly.
Figure 11:
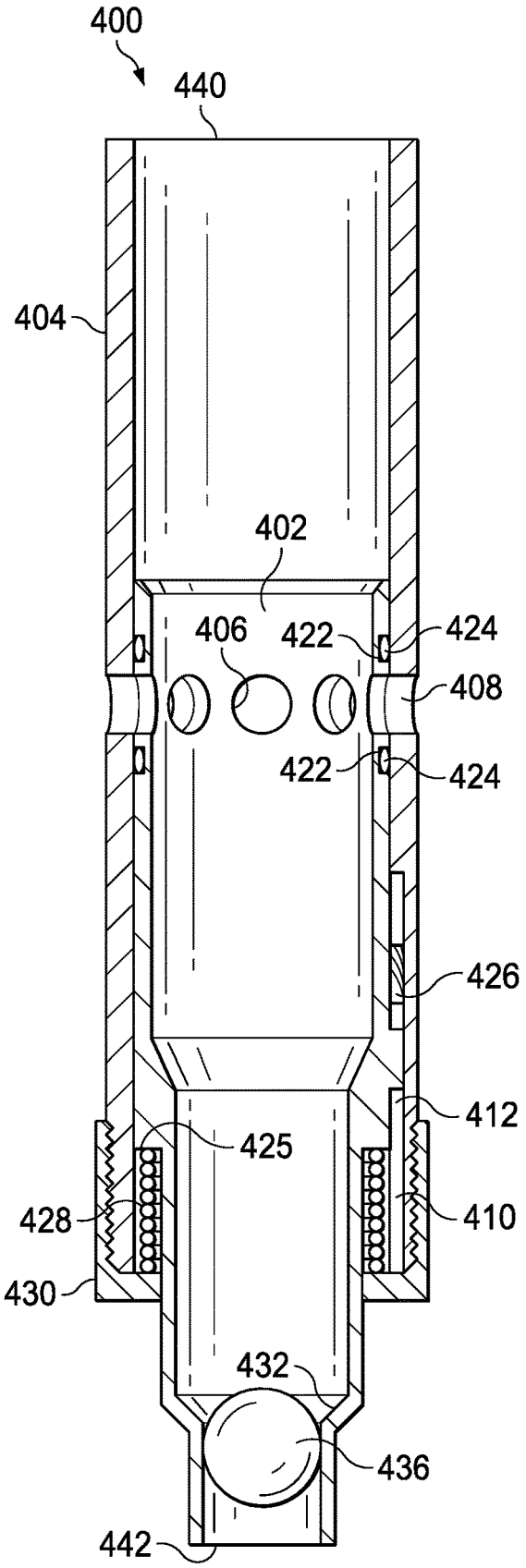
FIG. 11 is a schematic, cross-section view of the diverter assembly of FIG. 9 in which the diverter assembly is in a second configuration.

In FIG. 9A, the diverter assembly 400 is shown in the first configuration, in which the first apertures 406 are misaligned with the second apertures 408. In FIG. 10, a sealing member 436, which may be a ball or dart, is shown as being deployed to the sealing seat 432 of the inner sleeve 402. In FIG. 11, a pressure differential has been applied across the sealing member 436 to generate a pressure differential sufficient to cause the spring 428 to compress, resulting in the pin 426 tracking to the downhole portion of the first longitudinal track 412. Here, the diverter assembly 400 is in the second configuration in which the first apertures 406 are aligned with the second apertures 408 such that fluid is permitted to flow through the inlet 440 of the diverter assembly 400 and through the first apertures 406 and second apertures 408 to an annulus surrounding the outer sleeve 404.

Figure 12:
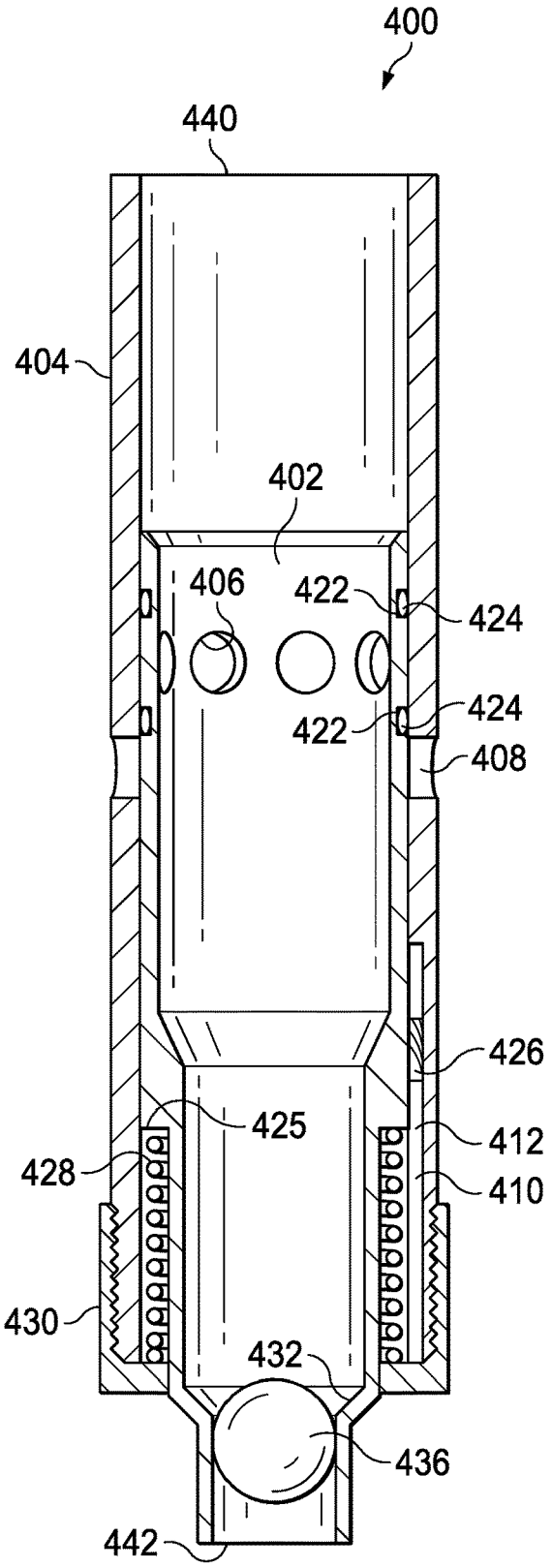
FIG. 12 is a schematic, cross-section view of the diverter assembly of FIG. 9 in which the diverter assembly is in a third configuration.

In FIG. 12, the pressure differential across the sealing member 436 is has been decreased such that the force generated by the spring 428 urges the inner sleeve 402 back toward the inlet 440, allowing a rotational force to urge the pin 426 through the first transition track 418 and into the second longitudinal track 414.

Figure 13:
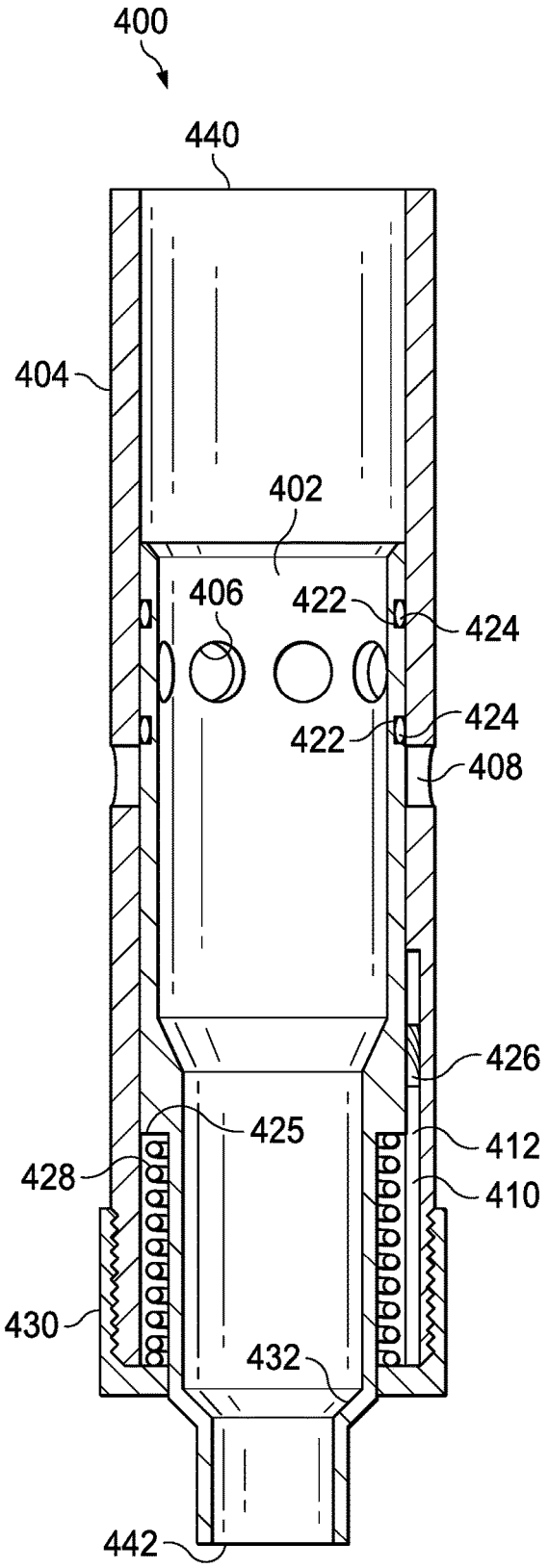
FIG. 13 is a schematic, cross-section view of the diverter assembly of FIG. 9 in which ball has been extruded through a ball seat of the diverter assembly.
Figure 14:
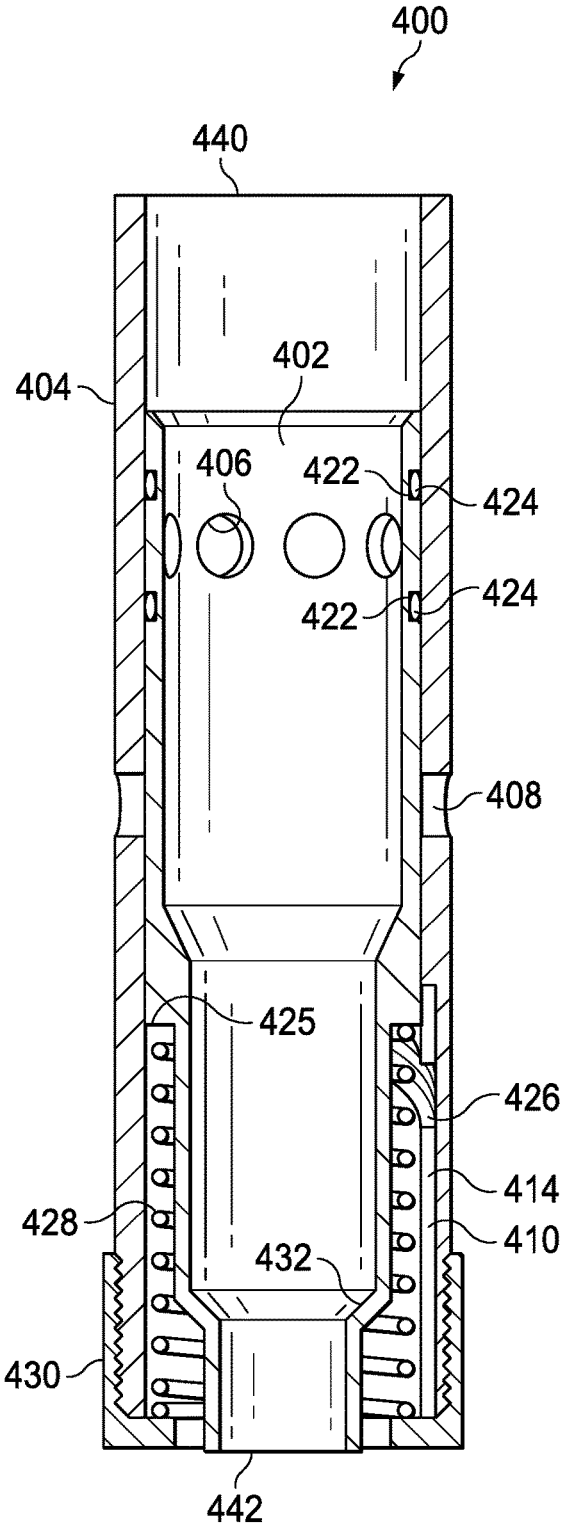
FIG. 14 is a schematic, cross-section view of the diverter assembly of FIG. 9.
Figure 15:
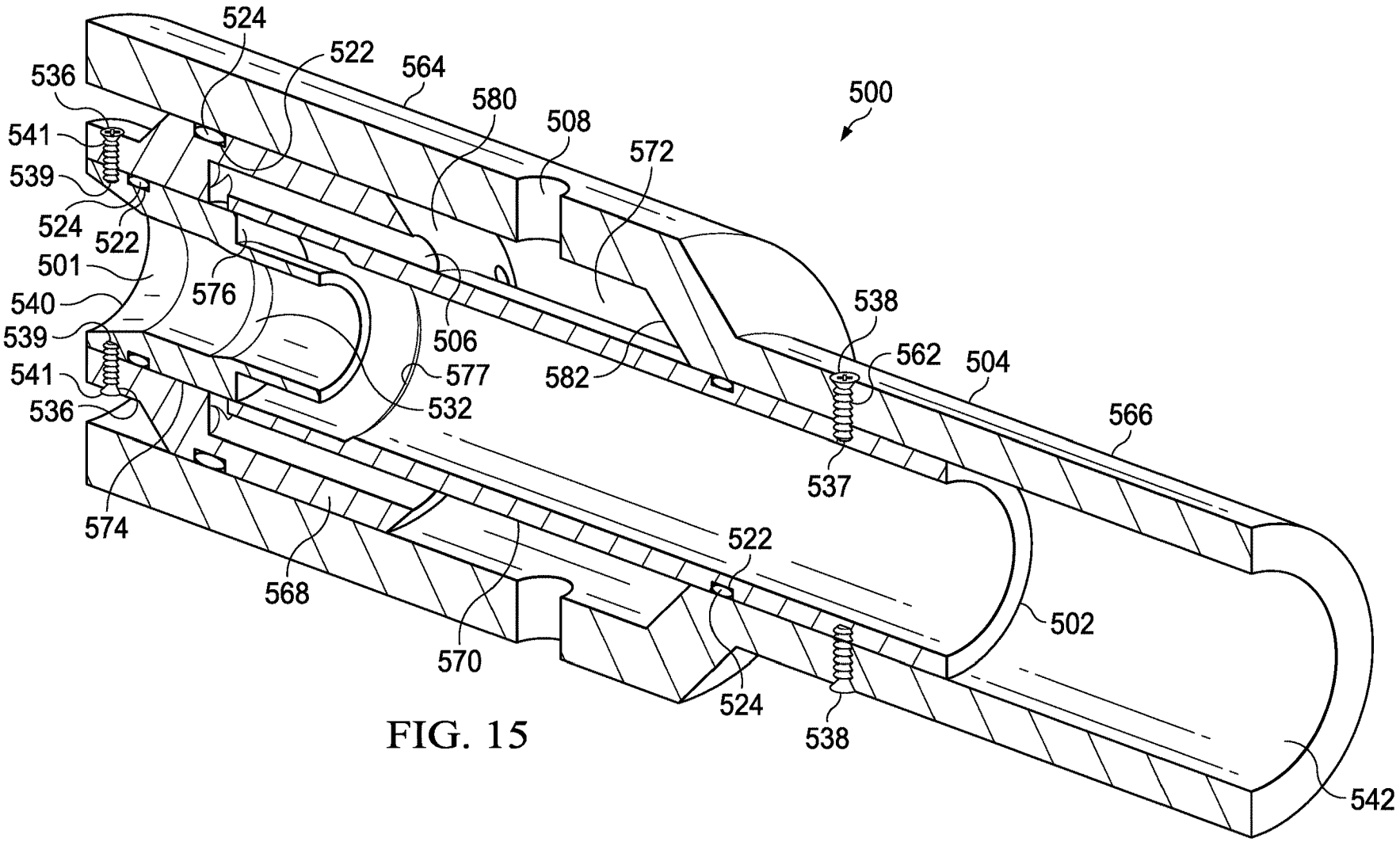
FIG. 15 is a schematic, perspective view, in cross-section, of another alternative embodiment of a diverter assembly in which the diverter assembly is in a first configuration.

In some embodiments, it is noted that the circuitous slot 410 may be substantially "Y" or "V" shaped, and arranged such that the spring 428 force will direct the pin 426 to the second longitudinal track 414 or a second location within the circuitous slot 410 without rotation of the work string. FIG. 13 shows the diverter assembly 400 after the pressure differential across the sealing member 436 has been increased to a second predetermined threshold to cause the sealing member 436 to extrude across the sealing seat 432. In FIG. 14, the spring 428 has expanded to transition the diverter assembly 400 to the third configuration in which the fluid flow path from the inlet 440 to the outlet 442 is unobstructed and the first apertures 406 are misaligned with the second apertures to restrict the flow of fluid from the inner sleeve 402 to the second apertures 408.

Another embodiment of a diverter assembly 500 is described with regard to FIGS. 15-20. In the illustrative embodiment, the diverter assembly 500 includes an outer sleeve 504 that has first apertures 508 extending from an inner bore of the outer sleeve 504 through an external surface of the outer sleeve 504. An outer fastening aperture 538 extends from the inner bore of the outer sleeve 504 and is configured to receive a fastener, shown here as second shearing fastener 562 (in view of first shearing fastener 541, described below). The shearing fasteners may be shear pins or shear screws that is are operable to fail by shearing when subjected to a predetermined shear force. The outer sleeve 504 includes an uphole portion 564 having a first inner diameter and a downhole portion 566 having a second inner diameter. The second inner diameter may be smaller than the first inner diameter.

The diverter assembly 500 also includes an intermediate sleeve 502 positioned within the outer sleeve 504. The intermediate sleeve 502 similarly has an uphole portion 568 and a downhole portion 570. The uphole portion 568 has a first outer diameter and the downhole portion 570 has a second outer diameter that is smaller than the first outer diameter. The intermediate sleeve 502 includes an intermediate flow path 506 or conduit extending from an inner bore of the uphole portion 568 of the intermediate sleeve 502 to a cavity 572 formed between the uphole portion 564 of the outer sleeve 504 and the downhole portion 570 of the intermediate sleeve 502. The intermediate sleeve 502 includes a first intermediate fastening aperture 536 and a second intermediate fastening aperture 537.

Positioned within the uphole portion 568 of the intermediate sleeve 502, the diverter assembly 500 also includes an inner sleeve 501. The inner sleeve 501 has an external sealing surface 574 adjoining an upper shoulder 576. The inner sleeve 501 also has a sealing seat 532 and an inner fastening aperture 539 extending from an outer surface of the inner sleeve 501.

In some embodiments, the external sealing surface 574 of the inner sleeve 501 comprises a groove 522 for receiving a seal 524, analogous to the grooves and seals described above with regard to the previously discussed embodiments. A similar groove 522 and seal 524 may be positioned in the intermediate sleeve 502 and or outer sleeve 504.

A first shearing fastener 541, similar to the second shearing fastener 562, extends from the first intermediate fastening aperture 536 to the inner fastening aperture 539 when the diverter assembly is in a first configuration. Similarly, second shearing fastener 562 extends from the outer fastening aperture 538 to the second intermediate fastening aperture 537 when the diverter assembly 500 is in the first configuration in which the external sealing surface 574 of the inner sleeve 501 restricts flow across the intermediate flow path 506 when the diverter assembly is in the first configuration. The diverter assembly 500 is shown in the first configuration in FIGS. 15 and 16.

Figure 18:
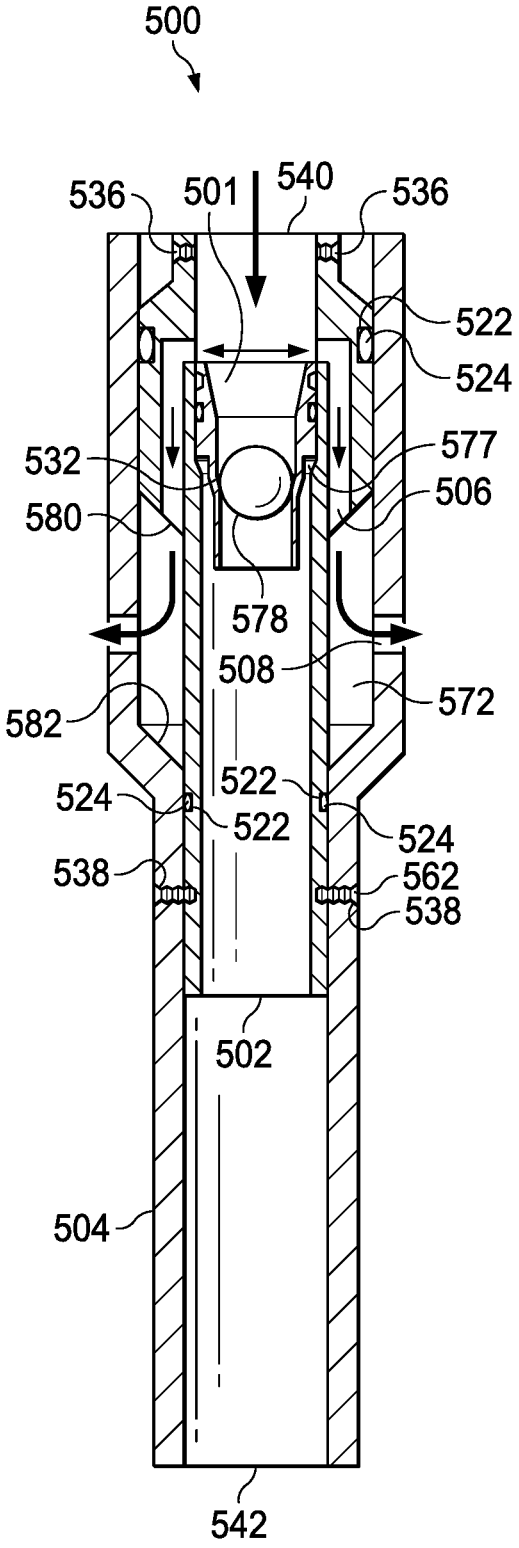
FIG. 18 is a schematic, cross-section view of the diverter assembly of FIG. 15 in which the diverter assembly is in a second configuration.

The sealing seat 532 of the inner sleeve 501 is positioned at or near the inlet 540 of the diverter assembly 500, and is operable to receive a projectile sealing member 578, such as a sealing ball or dart. Correspondingly, the first shearing fastener 541 is operable to fail when a first preselected pressure differential is applied across the projectile sealing member 578, and the diverter assembly 500 is operable to transition to a second configuration in which the inner sleeve 501 has slid downhole of an inlet of the intermediate flow path 506 following failure of the first shearing fastener 541, as shown in FIG. 18. In the second configuration, fluid flowing into the inlet 540 of the diverter assembly is restricted from flowing to outlet 542 by the projectile sealing member 478 and directed through the intermediate flow path 506 to the first apertures 508 via the cavity 572. The diverter assembly 500 is stabilized in the second configuration when the upper shoulder 576 of the inner sleeve 501 engages an inner shoulder 577 of the intermediate sleeve 502.

Figure 20:
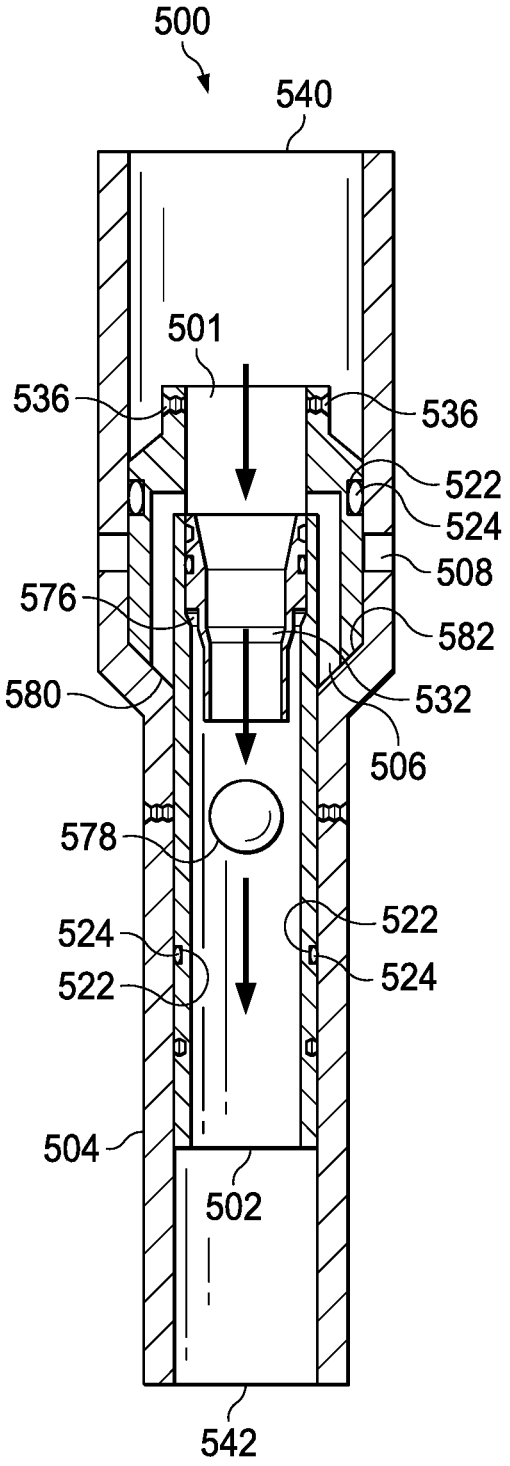
FIG. 20 is a schematic, cross-section view of the diverter assembly of FIG. 15 in the third configuration in which the ball has been extruded through the inner seat.

In some embodiments, the second shearing fastener 562 is operable to fail under a second preselected pressure differential across the projectile sealing member 578 when the diverter subassembly 500 is in the second configuration. Upon failure of the second shearing fastener 562, the diverter assembly 500 is operable to transition to a third configuration in which the uphole portion 568 of the intermediate sleeve 502 restricts flow across the first apertures 508, as shown in FIG. 20. In some embodiments, the second preselected pressure differential may be generated by an increase in volumetric flow from a fluid supply source (as shown in FIGS. 1 and 2) at the inlet of the diverter assembly 500. In some embodiments, the second preselected pressure differential may be generated (in whole or in part) by deploying an additive to fluid circulating to the diverter assembly 500. Examples of such additives include particles or foam balls (e.g., Perf-Pac balls) that can partially restrict flow to increase pressure differential and then be pumped down hole and out of the diverter assembly 500.

Figure 19:
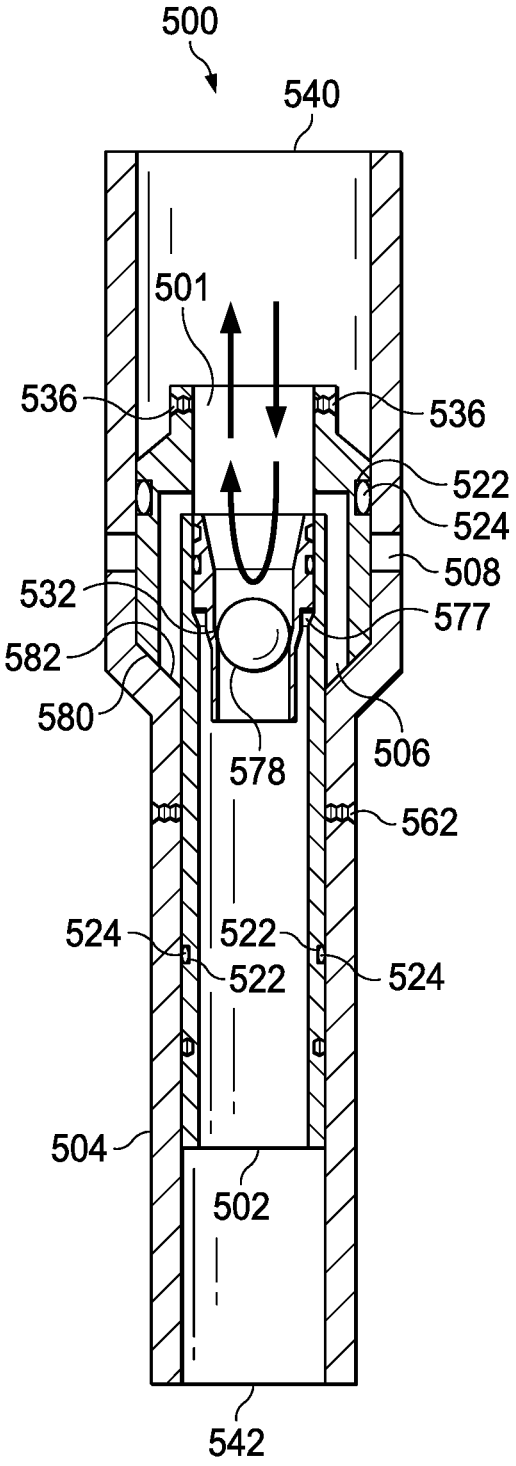
FIG. 19 is a schematic, cross-section view of the diverter assembly of FIG. 15 in which the diverter assembly is being transitioned to a third configuration.

FIG. 19 shows the diverter assembly 500 in a transitional configuration in which an outer shoulder 580 of the intermediate sleeve 502 engages a sealing shoulder 582 of the outer sleeve 504, and the projectile sealing member 578 is still positioned within the inner sleeve 501. The inner sleeve 501 has a thinner material at a downhole portion, and is thereby operable to allow the projectile sealing member 578 to extrude through the sealing seat 532 upon the application of a preselected pressure differential across the projectile sealing member 578.

As shown in FIG. 20, in the third configuration, the first apertures 508 of the outer sleeve 504 are occluded by the intermediate sleeve 502 and an inner flow path from the inlet 540 to the outlet 542 of the diverter assembly 500 is relatively unobstructed.

In operation, the systems and tools described above may be used in the context of, for example, a top-down squeeze operation by diverting fluid flow from a work string to an annulus surrounding the work string, as described with regard to FIGS. 1 and 2 above. For example, the diverter assemblies 200 and 300 of FIGS. 3-5 and 6-8, respectively, may be operated in accordance with the following illustrative method. Here, it is noted that many of the reference numerals applicable to the diverter assembly 200 and related methods are indexed by 100 to describe the similar features of diverter assembly 300, and for brevity may not be discussed further with regard to the illustrative method applicable to the operation of such embodiments. In accordance with the illustrative method, a fluid supply source may be operated to supply pressurized fluid, which may include drilling fluid, a spacer, a cement slurry, or any other suitable fluid to the inlet 240 of the diverter assembly 200 when the diverter assembly is in a first configuration, as shown in FIGS. 3 and 3A.

Displacement of the work string coupled to the diverter assembly 200 downhole relative to the portion of the work string coupled to the diverter assembly 200 uphole induces the pin 228 to follow the transition path 218. For example, the work string may be compressed and rotated to cause the pin 228 to follow the circuitous slot 210 downhole along the first longitudinal track 212, and placed in tension to cause the pin 228 to follow the circuitous slot back uphole, and across the first transition track 218 to the second longitudinal slot 214. When the pin 228 reaches the uphole portion of the second longitudinal slot 214, the diverter assembly is in the second configuration in which the first apertures 206 of the inner sleeve 202 are aligned with the second apertures 208 of the outer sleeve, as shown in FIG. 4. In the second configuration, alignment of the apertures permits fluid to flow from the inlet 240 through the first apertures 206 and second apertures 208 to the surrounding annulus. At or around this time, a downhole valve or sealing mechanism may be operated to restrict fluid flow within the work string downhole from the diverter assembly 200, thereby diverting fluid flow to the annulus to, for example, perform a top-down squeeze operation.

Following the squeeze or similar operation, the work string may be compressed and rotated again to cause the pin 228 to follow the circuitous slot 210 downhole along the second longitudinal track 214, and then placed in tension to cause the pin 228 to follow the circuitous slot back uphole, and across the second transition track 220 to the third longitudinal slot 216. When the pin 228 reaches the uphole portion of the third longitudinal slot 214, the diverter assembly is in the third second configuration in which the first apertures 206 of the inner sleeve 202 are again misaligned with the second apertures 208 of the outer sleeve, as shown in FIG. 5. In the third configuration, misalignment of the apertures prevents fluid from flowing from the inlet 240 through the first apertures 206 and second apertures 208 to the surrounding annulus, thereby causing downhole flow within the work string to resume. At or around this time, a downhole valve or sealing mechanism may be operated to facilitate fluid flow within the work string downhole from the diverter assembly 200.

Another illustrative method is described with regard to FIGS. 9-14. In accordance with the illustrative method, a fluid supply source may be operated to supply pressurized fluid to the inlet 440 of diverter assembly 400 when the diverter assembly 400 is in a first configuration, as shown in FIGS. 9 and 9A. To transition the diverter assembly 400 to the second configuration, a sealing member 436 is deployed to sealing seat 432, as shown in FIG. 10. Next, the fluid supply source may be operated to generate a pressure differential across the sealing member 436 sufficient to compress the spring 428. As the spring 428 compresses, the first apertures 406 of the inner sleeve 402 are brought into alignment with the second apertures 408 of the outer sleeve 404 to bring the diverter assembly into the second configuration. In the second configuration, fluid is permitted to flow from the inlet 440 of the diverter assembly 400 and through the first apertures 406 and second apertures 408 to the annulus to, for example, perform a top-down squeeze operation.

Following completion of the squeeze operation, the pressure differential across the sealing member 436 may be reduced so that the spring 428 urges the inner sleeve 402 back uphole, relative to the outer sleeve 404 as shown in FIG. 12. Rotation of the portion of the work string coupled to the diverter assembly 400 downhole relative to the portion of the work string coupled to the diverter assembly 400 uphole induces the pin 426 to follow the transition path 418 into the second longitudinal track 414. At this stage, the first apertures 406 are again misaligned with the second apertures 408 and the pressure differential across the sealing member 436 may be increased to a second predetermined threshold to cause the sealing member 436 to extrude across the sealing seat 432, as shown in FIG. 3. Extrusion of the sealing member 436 permits the spring 428 to urge the inner sleeve 402 uphole relative to the outer sleeve 404 such that the diverter assembly 400 reaches equilibrium in the third configuration. In this third configuration, the fluid flow path from the inlet 440 to the outlet is again unobstructed and fluid is permitted to flow downhole through the diverter assembly 400.

Figure 16:
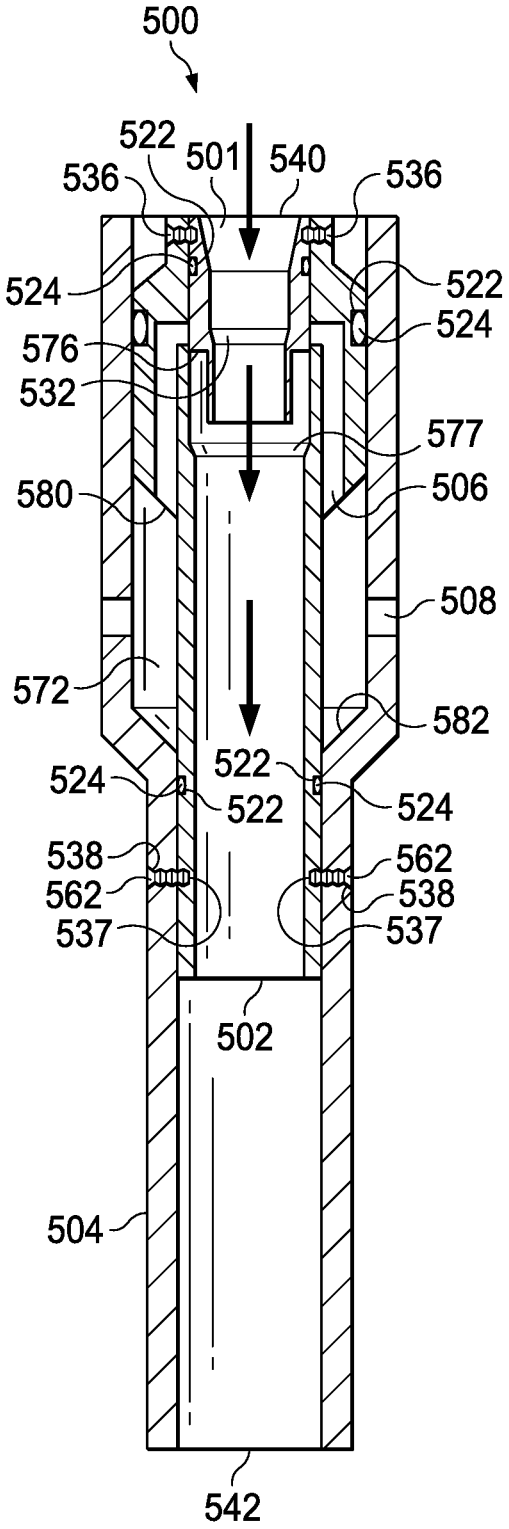
FIG. 16 is a schematic, cross-section view the diverter assembly of FIG. 15 in the first configuration.

In accordance with another illustrative embodiment, an illustrative method of operating a diverter assembly 500 in accordance with the embodiments of FIGS. 15-20 includes directing fluid flow in a work string, such as the work string 128 of FIGS. 1 and 2. The method includes directing flow to an inlet 540 of the diverter assembly 500 toward the outlet 542 of the diverter subassembly 500. When the diverter assembly 500 is in the first configuration, fluid flows downhole through the diverter assembly 500 from the inlet 540 and through the outlet 542, as shown in FIG. 16.

Figure 17:
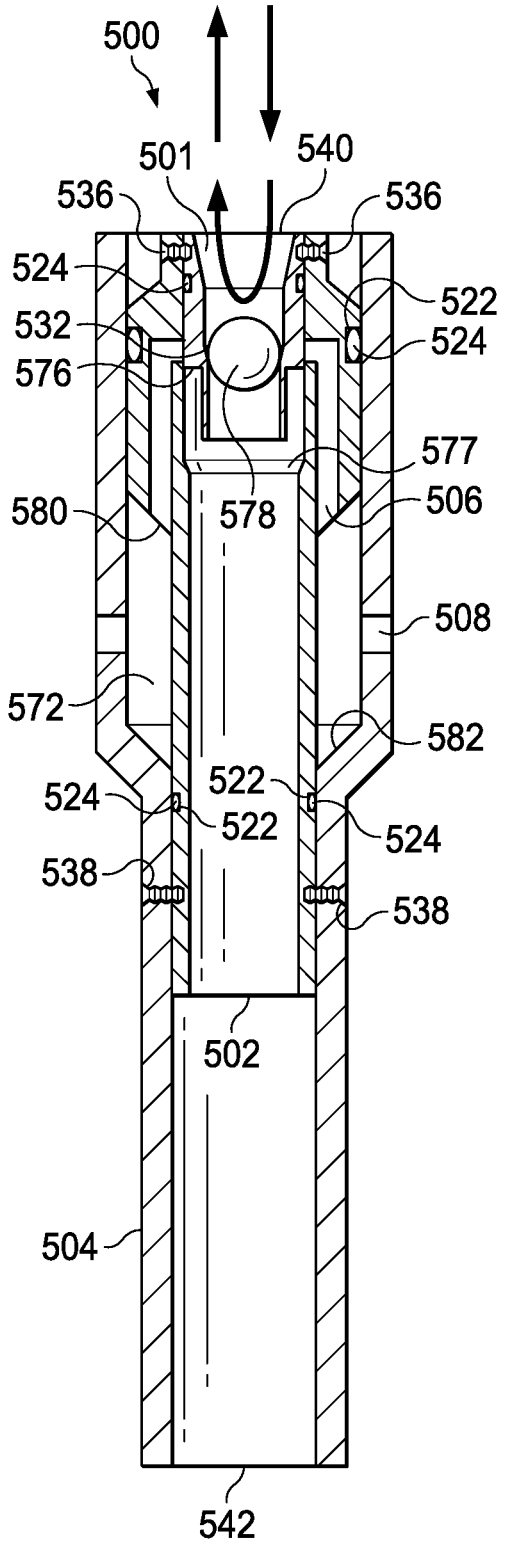
FIG. 17 is a schematic, cross-section view of the diverter assembly of FIG. 15 in which a ball has been deployed to an inner seat of the diverter assembly.

To divert fluid flow from the inlet 540 to an annulus surrounding the diverter assembly 500, a sealing member (e.g., projectile sealing member 578) is dropped into the work string and circulated to land at the sealing seat 532 of the inner sleeve 501, as shown in FIG. 17. The sealing member obstructs fluid flow through the diverter assembly 500 and allows for the build of a pressure differential between the inlet 540 and outlet 542 across a seal formed by the sealing seat 532 and sealing member. When the pressure differential reaches a first predetermined threshold, the first shearing fastener 541 fails, and the inner sleeve 501 is freed to slide downhole within the intermediate sleeve 502 until the upper shoulder 576 of the inner sleeve 501 engages the inner shoulder 577 of the intermediate sleeve 502, as shown in FIG. 18.

When the upper shoulder 576 of the inner sleeve 501 engages the inner shoulder 577 of the intermediate sleeve 502, fluid flow from the inlet 540 to the intermediate flow paths 506 is unrestricted and permitted to flow to the cavity 572 and through the first apertures 508 to the aforementioned annulus. At this stage, a fluid, such as a cement slurry, may be deployed to the annulus to perform a squeeze operation (as discussed above). Following completion of the squeeze, flow through the work string may be resumed by closing the intermediate fluid flow paths 506. To that end, volumetric flow rate may be increased until the pressure differential across the projectile sealing member 578 reaches a second predetermined threshold, thereby inducing failure of the second shearing fasteners 562.

Failure of the second shearing fasteners 562 frees the intermediate sleeve 502 to slide downhole within the outer sleeve 504 until the outer shoulder 580 of the intermediate sleeve 502 engages the sealing shoulder 582, collapsing the cavity 572. The collapsing of the cavity 572 closes the intermediate fluid flow paths 506, restricting flow to the annulus from the first apertures 508, as shown in FIG. 19. To resume downhole flow through the work string, the fluid supply source may be operated to increase the pressure differential at the sealing member 578 to a third predetermined threshold to cause the sealing member 578 to extrude across the sealing seat 532 and into the work string.

The scope of the claims is intended to broadly cover the disclosed embodiments and any such modification. Further, the following clauses represent additional embodiments of the disclosure and should be considered within the scope of the disclosure:

Clause 1: A downhole tool subassembly having an outer sleeve. The outer sleeve has a first set of apertures extending from an inner bore of the outer sleeve through an external surface of the outer sleeve. The downhole tool subassembly further includes a pin coupled to the outer sleeve and extending inward from the inner bore of the outer sleeve, and an inner sleeve slidingly engaged with the with outer sleeve. The inner sleeve has a slot and a second set of apertures extending from a sleeve bore of the inner sleeve through an external surface of the inner sleeve, and is operable to restrict flow across the first set of apertures when the inner sleeve is in a first position. The pin engages the slot, which includes a first tracking path and a second tracking path offset from the first tracking path. The slot also includes a first transition path extending from the first tracking path to the second tracking path.

Clause 2: The downhole tool subassembly of clause 1, wherein the slot further comprises a third tracking path offset from the second tracking path and a second transition path extending from the second tracking path to the third tracking path.

Clause 3: The downhole tool subassembly of clause 2, wherein the first tracking path, second tracking path, and third tracking path are parallel to an axis of the sleeve.

Clause 4: The downhole tool subassembly of clause 2 or 3, wherein the sleeve is operable permit flow across the first set of apertures and second set of apertures when the sleeve is moved to a second position in which the second set of apertures is at least partially aligned with the first set of apertures.

Clause 5: The downhole tool subassembly of clause 4, wherein the first position corresponds to the pin being in an uphole portion of the first tracking path, and wherein the second position corresponds to the pin being in an uphole portion of the second tracking path.

Clause 6: The downhole tool subassembly of clause 5, wherein the sleeve is operable restrict flow across the first set of apertures and second set of apertures when the sleeve is moved to a third position in which the second set of apertures is misaligned with the first set of apertures, and wherein the first position corresponds to the pin being in an uphole portion of the third tracking path.

Clause 7: The downhole tool subassembly of any of clauses 1-6, wherein the second set of apertures is offset from the first set of apertures by a preselected distance when the sleeve is in the first position, and wherein an uphole portion of the first tracking path is offset from an uphole portion of the second tracking path by the preselected distance.

Clause 8: The downhole tool subassembly of any of clauses 1-7, wherein the first set of apertures and second set of apertures are arranged parallel to a central axis of the outer sleeve.

Clause 9: The downhole tool subassembly of any of clauses 1-7, wherein the first set of apertures and second set of apertures are arranged perpendicular to a central axis of the outer sleeve.

Clause 10: The downhole tool subassembly of clause of any of clauses 1-9, further comprising a spring positioned between a cavity formed by an outer surface of the sleeve, an inner surface of the outer sleeve, and wherein the spring biases a shoulder of the sleeve away from an outer sleeve cap, the outer sleeve cap being coupled to a second end of the outer sleeve.

Clause 11: The downhole tool subassembly of clause 10, wherein the sleeve comprises a sealing seat.

Clause 12: A method of directing downhole flow in a wellbore including directing a fluid to an uphole portion of a downhole tool subassembly. The downhole tool subassembly includes an outer sleeve having a first set of apertures extending from an inner bore of the outer sleeve through an external surface of the outer sleeve. The downhole tool subassembly also includes a pin coupled to the outer sleeve and extending inward from the inner bore of the outer sleeve, and an inner sleeve that is slidingly engaged with the with the outer sleeve. The inner sleeve has a slot and a second set of apertures extending from a sleeve bore of the inner sleeve through an external surface of the inner sleeve. The inner sleeve is operable to restrict flow across the first set of apertures when the inner sleeve is in a first position. The pin of the outer sleeve engages the slot, which includes a first tracking path and a second tracking path that is offset from the first tracking path. The slot further includes a first transition path extending from the first tracking path to the second tracking path. The method also includes directing the fluid through the sleeve to a downhole portion of the downhole tool subassembly.

Clause 13: The method of clause 12, wherein the slot further comprises a third tracking path offset from the second tracking path and a second transition path extending from the second tracking path to the third tracking path.

Clause 14: The method of clause 12 or 13, further comprising displacing the sleeve relative to the outer sleeve to a second position in which the second set of apertures is at least partially aligned with the first set of apertures and diverting the fluid from the inner bore of the sleeve through the first set of apertures.

Clause 15: The method of clause 14, wherein displacing the sleeve relative to the outer sleeve to the second position comprises moving the pin from an uphole portion of the first tracking path to an uphole portion of the second tracking path.

Clause 16: The method of clause 14 or 15, further comprising displacing the sleeve relative to the outer sleeve to a third position in which the second set of apertures is misaligned with the first set of apertures to restrict flow through the first set of apertures and resume flow from the uphole portion of the downhole tool subassembly to the downhole portion of the downhole tool subassembly.

Clause 17: The method of clause 16, wherein displacing the sleeve relative to the outer sleeve to the third position comprises moving the pin from an uphole portion of the second tracking path to an uphole portion of the third tracking path.

Clause 18: A system for diverting flow from a work string comprising: a fluid supply source, a work string, and a downhole tool subassembly. The downhole tool subassembly includes an outer sleeve having a first set of apertures extending from an inner bore of the outer sleeve through an external surface of the outer sleeve, and a pin coupled to the outer sleeve and extending inward from the inner bore of the outer sleeve. The downhole tool subassembly further includes an inner sleeve that is slidingly engaged with the with outer sleeve. The inner sleeve has a slot and a second set of apertures extending from a sleeve bore of the inner sleeve through an external surface of the inner sleeve. The inner sleeve is operable to restrict flow across the first set of apertures when the inner sleeve is in a first position. The pin engages the slot, which includes a first tracking path, a second tracking path offset from the first tracking path, and a first transition path extending from the first tracking path to the second tracking path.

Clause 19: The system of clause 18, wherein the slot further comprises a third tracking path offset from the second tracking path and a second transition path extending from the second tracking path to the third tracking path.

Clause 20: The system of clause 19, wherein the first tracking path, second tracking path, and third tracking path are parallel to an axis of the sleeve.

Clause 21: The system of clause 19 or 20, wherein the sleeve is operable permit flow across the first set of apertures and second set of apertures when the sleeve is moved to a second position in which the second set of apertures is at least partially aligned with the first set of apertures.

Clause 22: The system of clause 21, wherein the first position corresponds to the pin being in an uphole portion of the first tracking path, and wherein the second position corresponds to the pin being in an uphole portion of the second tracking path.

Clause 23: The system of clause 22, wherein the sleeve is operable restrict flow across the first set of apertures and second set of apertures when the sleeve is moved to a third position in which the second set of apertures is misaligned with the first set of apertures, and wherein the first position corresponds to the pin being in an uphole portion of the third tracking path.

Clause 24: The system of any of clauses 18-23, wherein the second set of apertures is offset from the first set of apertures by a preselected distance when the sleeve is in the first position, and wherein an uphole portion of the first tracking path is offset from an uphole portion of the second tracking path by the preselected distance.

Clause 25: The system of any of clauses 18-24, wherein the first set of apertures and second set of apertures are arranged parallel to a central axis of the outer sleeve.

Clause 26: The system of any of clauses 18-24, wherein the first set of apertures and second set of apertures are arranged perpendicular to a central axis of the outer sleeve.

Clause 27: The system of any of clauses 18-26, wherein the downhole tool subassembly further comprises a spring positioned between a cavity formed by an outer surface of the sleeve, an inner surface of the outer sleeve, and wherein the spring biases a shoulder of the sleeve away from an outer sleeve cap, the outer sleeve cap being coupled to a second end of the outer sleeve.

Clause 28: The method of clause 27, wherein the sleeve comprises a sealing seat.

Unless otherwise specified, any use of any form of the terms "connect," "engage," "couple," "attach," or any other term describing an interaction between elements in the foregoing disclosure is not meant to limit the interaction to direct interaction between the elements and may also include indirect interaction between the elements described. As used herein, the singular forms "a", "an" and "the" are intended to include the plural forms as well, unless the context clearly indicates otherwise. Unless otherwise indicated, as used throughout this document, "or" does not require mutual exclusivity. It will be further understood that the terms "comprise" and/or "comprising," when used in this specification and/or the claims, specify the presence of stated features, steps, operations, elements, and/or components, but do not preclude the presence or addition of one or more other features, steps, operations, elements, components, and/or groups thereof. In addition, the steps and components described in the above embodiments and figures are merely illustrative and do not imply that any particular step or component is a requirement of a claimed embodiment.

It should be apparent from the foregoing that embodiments of an invention having significant advantages have been provided. While the embodiments are shown in only a few forms, the embodiments are not limited but are susceptible to various changes and modifications without departing from the spirit thereof.

We claim:

1. A downhole tool subassembly comprising:

an outer sleeve having a first set of apertures extending from an inner bore of the outer sleeve through an external surface of the outer sleeve;

a pin coupled to the outer sleeve and extending inward from the inner bore of the outer sleeve; and an inner sleeve slidingly engaged with the outer sleeve and having a slot and a second set of apertures extending from a sleeve bore of the inner sleeve through an external surface of the inner sleeve, the inner sleeve being operable to restrict flow across the first set of apertures when the inner sleeve is in a first position, wherein the pin engages the slot, and wherein the slot comprises a first tracking path, a second tracking path offset from the first tracking path, and a first transition path extending from the first tracking path to the second tracking path;

wherein the slot further comprises a third tracking path offset from the second tracking path and a second transition path extending from the second tracking path to the third tracking path;

wherein the inner sleeve is operable to permit flow across the first set of apertures and second set of apertures when the sleeve is moved to a second position in which the second set of apertures is at least partially aligned with the first set of apertures;

wherein the first position corresponds to the pin being in an uphole portion of the first tracking path, and wherein the second position corresponds to the pin being in an uphole portion of the second tracking path.

2. The downhole tool subassembly of claim 1, wherein the first tracking path, second tracking path, and third tracking path are parallel to an axis of the sleeve.

3. The downhole tool subassembly of claim 1, wherein the inner sleeve is operable to restrict flow across the first set of apertures and second set of apertures when the inner sleeve is moved to a third position in which the second set of apertures is misaligned with the first set of apertures, and wherein the first position corresponds to the pin being in an uphole portion of the third tracking path.

4. The downhole tool subassembly of claim 1, wherein the second set of apertures is offset from the first set of apertures by a preselected distance when the inner sleeve is in the first position, and wherein an uphole portion of the first tracking path is offset from an uphole portion of the second tracking path by the preselected distance.

5. The downhole tool subassembly of claim 1, wherein the first set of apertures and second set of apertures are arranged parallel to a central axis of the outer sleeve.

6. The downhole tool subassembly of claim 1, wherein the first set of apertures and second set of apertures are arranged perpendicular to a central axis of the outer sleeve.

7. The downhole tool subassembly of claim 1, further comprising a spring positioned between a cavity formed by an outer surface of the inner sleeve, an inner surface of the outer sleeve, and wherein the spring biases a shoulder of the inner sleeve away from an outer sleeve cap, the outer sleeve cap being coupled to a second end of the outer sleeve.

8. The downhole tool subassembly of claim 7, wherein the inner sleeve comprises a sealing seat.

9. A method of directing downhole flow in a wellbore comprising:

directing a fluid to an uphole portion of a downhole tool subassembly comprising:

an outer sleeve having a first set of apertures extending from an inner bore of the outer sleeve through an external surface of the outer sleeve;

a pin coupled to the outer sleeve and extending inward from the inner bore of the outer sleeve; and an inner sleeve slidingly engaged with the with outer sleeve and having a slot and a second set of apertures extending from a sleeve bore of the inner sleeve through an external surface of the inner sleeve, the inner sleeve being operable to restrict flow across the first set of apertures when the inner sleeve is in a first position, wherein the pin engages the slot, and wherein the slot comprises a first tracking path, a second tracking path offset from the first tracking path, and a first transition path extending from the first tracking path to the second tracking path, wherein the method further comprises directing the fluid through the inner sleeve to a downhole portion of the downhole tool subassembly;

wherein the method further comprises displacing the inner sleeve relative to the outer sleeve to a second position in which the second set of apertures is at least partially aligned with the first set of apertures and diverting the fluid from the inner bore of the inner sleeve through the first set of apertures;

wherein displacing the inner sleeve relative to the outer sleeve to the second position comprises moving the pin from an uphole portion of the first tracking path to an uphole portion of the second tracking path.

10. The method of claim 9, wherein the slot further comprises a third tracking path offset from the second tracking path and a second transition path extending from the second tracking path to the third tracking path.

11. The method of claim 9, further comprising displacing the inner sleeve relative to the outer sleeve to a third position in which the second set of apertures is misaligned with the first set of apertures to restrict flow through the first set of apertures and resume flow from the uphole portion of the downhole tool subassembly to the downhole portion of the downhole tool subassembly.

12. The method of claim 11, wherein displacing the inner sleeve relative to the outer sleeve to the third position comprises moving the pin from an uphole portion of the second tracking path to an uphole portion of the third tracking path.

13. A system for diverting flow from a work string comprising:

a fluid supply source;

a work string; and a downhole tool subassembly, wherein the downhole tool subassembly comprises an outer sleeve having a first set of apertures extending from an inner bore of the outer sleeve through an external surface of the outer sleeve;

wherein the downhole tool subassembly further comprises a pin coupled to the outer sleeve and extending inward from the inner bore of the outer sleeve; and wherein the downhole tool subassembly further comprises a inner sleeve slidingly engaged with the with outer sleeve and having a slot and a second set of apertures extending from a sleeve bore of the inner sleeve through an external surface of the inner sleeve, the inner sleeve being operable to restrict flow across the first set of apertures when the inner sleeve is in a first position, wherein the pin engages the slot, and wherein the slot comprises a first tracking path, a second tracking path offset from the first tracking path, and a first transition path extending from the first tracking path to the second tracking path;

wherein the slot further comprises a third tracking path offset from the second tracking path and a second transition path extending from the second tracking path to the third tracking path;

wherein the inner sleeve is operable to permit flow across the first set of apertures and second set of apertures when the sleeve is moved to a second position in which the second set of apertures is at least partially aligned with the first set of apertures;

wherein the first position corresponds to the pin being in an uphole portion of the first tracking path, and wherein the second position corresponds to the pin being in an uphole portion of the second tracking path.

14. The system of claim 13, wherein the first tracking path, second tracking path, and third tracking path are parallel to an axis of the inner sleeve.

* * * * *